US008980510B2

(12) United States Patent
Fujii et al.

(10) Patent No.: US 8,980,510 B2
(45) Date of Patent: Mar. 17, 2015

(54) ELECTROPHOTOGRAPHIC PHOTOSENSITIVE MEMBER, PROCESS CARTRIDGE AND ELECTROPHOTOGRAPHIC APPARATUS, AND METHOD FOR PRODUCING ELECTROPHOTOGRAPHIC PHOTOSENSITIVE MEMBER

(71) Applicant: Canon Kabushiki Kaisha, Tokyo (JP)

(72) Inventors: Atsushi Fujii, Yokohama (JP); Hiroyuki Tomono, Numazu (JP); Haruyuki Tsuji, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/972,688

(22) Filed: Aug. 21, 2013

(65) Prior Publication Data

US 2014/0065529 A1 Mar. 6, 2014

(30) Foreign Application Priority Data

| | | |
|---|---|---|
| Aug. 30, 2012 | (JP) | 2012-189531 |
| Jan. 25, 2013 | (JP) | 2013-012117 |
| Jan. 25, 2013 | (JP) | 2013-012125 |
| Mar. 15, 2013 | (JP) | 2013-053506 |

(51) Int. Cl.

| | |
|---|---|
| ***G03G 5/00*** | (2006.01) |
| ***G03G 5/047*** | (2006.01) |
| ***G03G 5/10*** | (2006.01) |
| ***G03G 5/14*** | (2006.01) |

(52) U.S. Cl.

CPC ..... *G03G 5/047* (2013.01); *G03G 5/104* (2013.01); *G03G 5/144* (2013.01)

USPC ..... 430/63; 430/131; 399/159

(58) Field of Classification Search

CPC ..... G03G 5/144

USPC ..... 430/63, 131; 399/159

See application file for complete search history.

(56) References Cited

U.S. PATENT DOCUMENTS

| | | | |
|---|---|---|---|
| 5,357,320 | A | 10/1994 | Kashimura et al. |
| 5,385,797 | A | 1/1995 | Nagahara et al. |

(Continued)

FOREIGN PATENT DOCUMENTS

| | | | |
|---|---|---|---|
| JP | 1-150150 | A | 6/1989 |
| JP | 1-248158 | A | 10/1989 |

(Continued)

OTHER PUBLICATIONS

European Search Report dated Nov. 14, 2013 in European Application No. 13182131.6.

*Primary Examiner* — Mark A Chapman

(74) *Attorney, Agent, or Firm* — Fitzpatrick, Cella, Harper and Scinto

(57) ABSTRACT

An electrophotographic photosensitive member in which a leakage hardly occurs, a process cartridge and electrophotographic apparatus having the electrophotographic photosensitive member, and a method for producing the electrophotographic photosensitive member are provided. The conductive layer in the electrophotographic photosensitive member contains metal oxide particle coated with tin oxide doped with niobium or tantalum. The relations: Ia≤6,000 and 10≤Ib are satisfied. The conductive layer before the test is performed has a volume resistivity of not less than $1.0\times10^{8}$ Ω·cm and not more than $5.0\times10^{12}$ Ω·cm.

18 Claims, 5 Drawing Sheets

(56) References Cited

U.S. PATENT DOCUMENTS

| | | | |
|---|---|---|---|
| 5,422,210 | A | 6/1995 | Maruyama et al. |
| 5,455,135 | A | 10/1995 | Maruyama et al. |
| 5,485,250 | A | 1/1996 | Kashimura et al. |
| 6,773,856 | B2 | 8/2004 | Tanaka et al. |
| 7,245,851 | B2 | 7/2007 | Fujii et al. |
| 7,276,318 | B2 | 10/2007 | Fujii et al. |
| 7,333,752 | B2 | 2/2008 | Kawahara et al. |
| 7,517,626 | B2 | 4/2009 | Fujii et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 2012/0114375 | A1 | 5/2012 | Fujii et al. |
| 2012/0121291 | A1 | 5/2012 | Tsuji et al. |
| 2013/0316283 | A1 | 11/2013 | Fujii et al. |
| 2013/0323632 | A1 | 12/2013 | Fujii et al. |
| 2014/0004452 | A1 | 1/2014 | Sekiya et al. |
| 2014/0004453 | A1 | 1/2014 | Kaku et al. |
| 2014/0004454 | A1 | 1/2014 | Okuda et al. |
| 2014/0093277 | A1 | 4/2014 | Fujii et al. |

FOREIGN PATENT DOCUMENTS

| | | | |
|---|---|---|---|
| JP | 2004-151349 | A | 5/2004 |
| JP | 2004-349167 | A | 12/2004 |
| JP | 2010-30886 | A | 2/2010 |
| JP | 2011-53406 | A | 3/2011 |
| WO | 2011/027911 | A1 | 3/2011 |
| WO | 2011/027912 | A1 | 3/2011 |

ELECTROPHOTOGRAPHIC PHOTOSENSITIVE MEMBER, PROCESS CARTRIDGE AND ELECTROPHOTOGRAPHIC APPARATUS, AND METHOD FOR PRODUCING ELECTROPHOTOGRAPHIC PHOTOSENSITIVE MEMBER

BACKGROUND OF THE INVENTION

1. Field of the Invention

The present invention relates to an electrophotographic photosensitive member, a process cartridge and electrophotographic apparatus having the electrophotographic photosensitive member, and a method for producing an electrophotographic photosensitive member.

2. Description of the Related Art

Recently, research and development of electrophotographic photosensitive members (organic electrophotographic photosensitive members) using an organic photoconductive material have been performed actively.

The electrophotographic photosensitive member basically includes a support and a photosensitive layer formed on the support. Actually, however, in order to cover defects of the surface of the support, protect the photosensitive layer from electrical damage, improve charging properties, and improve charge injection prohibiting properties from the support to the photosensitive layer, a variety of layers is often provided between the support and the photosensitive layer.

Among the layers provided between the support and the photosensitive layer, as a layer provided to cover defects of the surface of the support, a layer containing a metal oxide particle is known. Usually, the layer containing a metal oxide particle has a higher conductivity than that of a layer containing no metal oxide particle (for example, volume resistivity of $1.0\times10^{8}$ to $5.0\times10^{12}$ Ω·cm). Accordingly, even if the film thickness of the layer is increased, residual potential is hardly increased at the time of forming an image. For this reason, the defects of the surface of the support are easily covered. Such a highly conductive layer (hereinafter, referred to as a "conductive layer") is provided between the support and the photosensitive layer to cover the defects of the surface of the support. Thereby, the tolerable range of the defects of the surface of the support is wider. As a result, the tolerable range of the support to be used is significantly wider, leading to an advantage in that productivity of the electrophotographic photosensitive member can be improved.

Japanese Patent Application Laid-Open No. 2004-151349 describes a technique in which a tin oxide particle doped with tantalum is used for an intermediate layer provided between a support and a barrier layer or a photosensitive layer. Japanese Patent Application Laid-Open No. H01-248158 and Japanese Patent Application Laid-Open No. H01-150150 describe a technique in which a tin oxide particle doped with niobium is used for a conductive layer or intermediate layer provided between a support and a photosensitive layer.

However, examination by the present inventors has revealed that if an image is repeatedly formed under a low temperature and low humidity environment using an electrophotographic photosensitive member employing the layer containing such a metal oxide particle as the conductive layer, then a leakage is likely to occur in the electrophotographic photosensitive member. The leakage is a phenomenon such that a portion of the electrophotographic photosensitive member locally breaks down, and excessive current flows in that portion. If the leakage occurs, the electrophotographic photosensitive member cannot be sufficiently charged, leading to image defects such as black dots and horizontal black stripes. The horizontal black stripes are black stripes that appear in the direction intersecting perpendicular to the rotational direction (circumferential direction) of the electrophotographic photosensitive member.

SUMMARY OF THE INVENTION

An object of the present invention is to provide an electrophotographic photosensitive member in which a leakage hardly occurs even if the electrophotographic photosensitive member uses a layer containing a metal oxide particle as a conductive layer, and provide a process cartridge and electrophotographic apparatus having the electrophotographic photosensitive member, and a method for producing the electrophotographic photosensitive member.

The present invention is an electrophotographic photosensitive member including a cylindrical support, a conductive layer formed on the cylindrical support, and a photosensitive layer formed on the conductive layer, wherein the conductive layer contains metal oxide particle coated with tin oxide doped with niobium or tantalum, and a binder material, Ia and Ib satisfy relations (i) and (ii) where, in the relation (i), Ia [μA] is an absolute value of the largest amount of a current flowing through the conductive layer when a test which continuously applies a voltage having only a DC voltage of −1.0 kV to the conductive layer is performed, and, in the relation (ii), Ib [μA] is an absolute value of an amount of a current flowing through the conductive layer when a decrease rate per minute of the current flowing through the conductive layer reaches 1% or less for the first time, $$Ia\leq 6{,}000 \quad \text{(i)}$$

$$10\leq Ib \quad \text{(ii), and}$$

the conductive layer before the test is performed has a volume resistivity of not less than $1.0\times10^{8}$ Ω·cm and not more than $5.0\times10^{12}$ Ω·cm.

Moreover, the present invention is a process cartridge that integrally supports: the electrophotographic photosensitive member and at least one unit selected from the group consisting of a charging unit, a developing unit, a transferring unit, and a cleaning unit, the cartridge being detachably mountable on a main body of an electrophotographic apparatus.

Moreover, the present invention is an electrophotographic apparatus including the electrophotographic photosensitive member, a charging unit, an exposing unit, a developing unit, and a transferring unit.

Moreover, the present invention is a method for producing an electrophotographic photosensitive member including: forming a conductive layer having a volume resistivity of not less than $1.0\times10^{8}$ Ω·cm and not more than $5.0\times10^{12}$ Ω·cm on a cylindrical support, and forming a photosensitive layer on the conductive layer, wherein the formation of the conductive layer is preparing a coating solution for a conductive layer using a solvent, a binder material, and metal oxide particle coated with tin oxide doped with niobium or tantalum, and forming the conductive layer using the coating solution for a conductive layer, the metal oxide particle coated with tin oxide doped with niobium or tantalum used for preparation of the coating solution for a conductive layer has a powder resistivity of not less than $1.0\times10^{3}$ Ω·cm and not more than $1.0\times10^{5}$ Ω·cm, and the mass ratio (P/B) of the metal oxide particle coated with tin oxide doped with niobium or tantalum (P) to the binder material (B) in the coating solution for a conductive layer is not less than 1.5/1.0 and not more than 3.5/1.0.

The present invention can provide an electrophotographic photosensitive member in which a leakage hardly occurs even if the electrophotographic photosensitive member uses a layer containing a metal oxide particle as the conductive layer, and provide a process cartridge and electrophotographic apparatus having the electrophotographic photosensitive member, and a method for producing the electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The electrophotographic photosensitive member according to the present invention is an electrophotographic photosensitive member including a cylindrical support (hereinafter, also referred to as a "support"), a conductive layer formed on the cylindrical support, and a photosensitive layer formed on the conductive layer.

An electrophotographic photosensitive member produced by a production method according to the present invention is an electrophotographic photosensitive member including a support, a conductive layer formed on the support, and a photosensitive layer formed on the conductive layer. The photosensitive layer may be a single photosensitive layer in which a charge-generating substance and a charge transport substance are contained in a single layer, or a laminated photosensitive layer in which a charge-generating layer containing a charge-generating substance and a charge transport layer containing a charge transport substance are laminated. Moreover, when necessary, an undercoat layer (also referred to as an intermediate layer or barrier layer) may be provided between the conductive layer and the photosensitive layer.

As the support, those having conductivity (conductive support) can be used, and metallic supports formed with a metal such as aluminum, an aluminum alloy, and stainless steel can be used. In a case where aluminum or an aluminum alloy is used, an aluminum tube produced by a production method including extrusion and drawing or an aluminum tube produced by a production method including extrusion and ironing can be used. Such an aluminum tube has high precision of the size and surface smoothness without machining the surface, and has an advantage from the viewpoint of cost. However, defects like ragged projections are likely to be produced on the surface of the aluminum tube not machined. Accordingly, provision of the conductive layer is particularly effective.

In the present invention, in order to cover the defects of the surface of the support, the conductive layer having a volume resistivity of not less than $1.0\times10^{8}$ Ω·cm and not more than $5.0\times10^{12}$ Ω·cm is provided on the support. When the DC voltage continuous application test described later is performed, the volume resistivity of the conductive layer means the volume resistivity measured before the DC voltage continuous application test. As a layer for covering defects of the surface of the support, if a layer having a volume resistivity of more than $5.0\times10^{12}$ Ω·cm is provided on the support, a flow of charges is likely to stagnate during image formation to increase the residual potential. On the other hand, if the volume resistivity of a conductive layer is less than $1.0\times10^{8}$ Ω·cm, an excessive amount of charges flows in the conductive layer, and leakages are likely to be caused.

Figure 2:
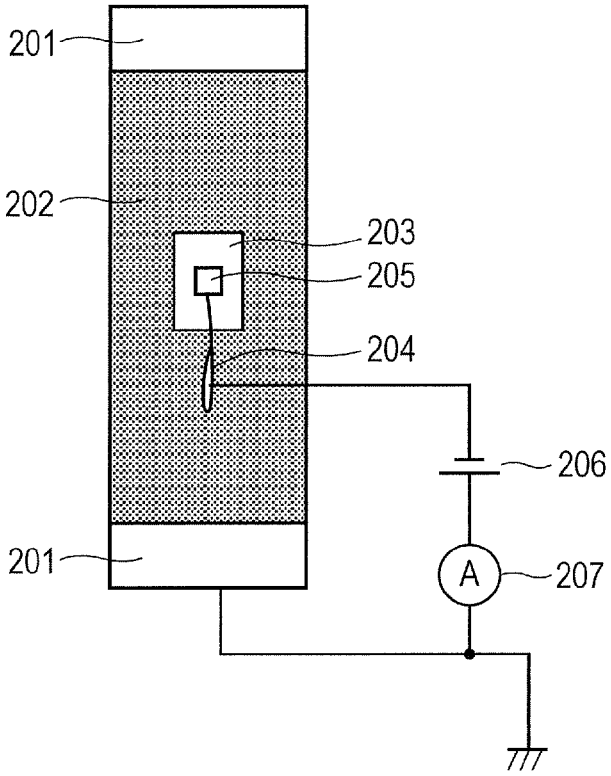
FIG. 2 is a drawing (top view) for describing a method for measuring a volume resistivity of a conductive layer.
Figure 3:
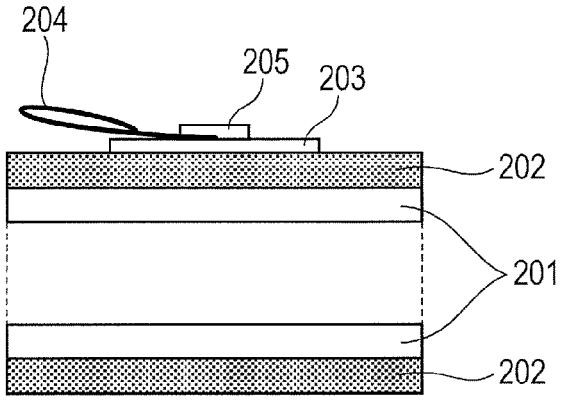
FIG. 3 is a drawing (sectional view) for describing a method for measuring a volume resistivity of a conductive layer.

Using FIG. 2 and FIG. 3, a method for measuring the volume resistivity of the conductive layer in the electrophotographic photosensitive member will be described. FIG. 2 is a top view for describing a method for measuring a volume resistivity of a conductive layer, and FIG. 3 is a sectional view for describing a method for measuring a volume resistivity of a conductive layer.

The volume resistivity of the conductive layer is measured under an environment of normal temperature and normal humidity (23° C./50% RH). A copper tape 203 (made by Sumitomo 3M Limited, No. 1181) is applied to the surface of the conductive layer 202, and the copper tape is used as an electrode on the side of the surface of the conductive layer 202. The support 201 is used as an electrode on a rear surface side of the conductive layer 202. Between the copper tape 203 and the support 201, a power supply 206 for applying voltage, and a current measurement apparatus 207 for measuring the current that flows between the copper tape 203 and the support 201 are provided. In order to apply voltage to the copper tape 203, a copper wire 204 is placed on the copper tape 203, and a copper tape 205 similar to the copper tape 203 is applied onto the copper wire 204 such that the copper wire 204 is not out of the copper tape 203, to fix the copper wire 204 to the copper tape 203. The voltage is applied to the copper tape 203 using the copper wire 204.

The value represented by the following relation (1) is the volume resistivity ρ [Ω·cm] of the conductive layer 202 wherein $I_0$ [A] is a background current value when no voltage is applied between the copper tape 203 and the support 201, I [A] is a current value when −1 V of the voltage having only a DC voltage (DC component) is applied, the film thickness of the conductive layer 202 is d [cm], and the area of the electrode (copper tape 203) on the surface side of the conductive layer 202 is S [$cm^2$]:

$$\rho=1/(I-I_0)\times S/d[\Omega\cdot\text{cm}] \quad (1)$$

In this measurement, a slight amount of the current of not more than $1\times10^{-6}$ A in an absolute value is measured. Accordingly, the measurement is preferably performed using a current measurement apparatus 207 that can measure such a slight amount of the current. Examples of such an apparatus include a pA meter (trade name: 4140B) made by Yokogawa Hewlett-Packard Ltd.

The volume resistivity of the conductive layer indicates the same value when the volume resistivity is measured in the state where only the conductive layer is formed on the support and in the state where the respective layers (such as the photosensitive layer) on the conductive layer are removed from the electrophotographic photosensitive member and only the conductive layer is left on the support.

In the present invention, the conductive layer can be formed using a coating solution for a conductive layer prepared using a solvent, a binder material, and metal oxide particle coated with tin oxide doped with niobium or tantalum. Namely, in the present invention, metal oxide particle coated with tin oxide doped with niobium or tantalum is used as the metal oxide particle for a conductive layer. The metal oxide particle coated with tin oxide doped with niobium or tantalum is also referred to as a "metal oxide particle coated with Nb/Ta-doped tin oxide" below. The metal oxide particle coated with Nb/Ta-doped tin oxide used in the present invention includes a core material particle formed of a metal oxide and a coating layer formed of tin oxide doped with niobium or tantalum, and has a structure in which the core material particle is coated with the coating layer. The particle having the structure in which the core material particle is coated with the coating layer is also referred to a composite particle.

The metal oxide that forms the core material particle is mainly classified into the same tin oxide as the tin oxide that forms the coating layer and a metal oxide other than the tin oxide. Among the metal oxides that form the core material particle, examples of the metal oxide other than tin oxide include titanium oxide, zirconium oxide, and zinc oxide. Among these, titanium oxide and zinc oxide are suitably used. The metal oxide that forms the core material particle is preferably a non-doped metal oxide. When the metal oxide that forms the core material particle is tin oxide and the tin oxide is non-doped, the coating layer corresponds to a portion doped with niobium or tantalum, and the core material particle corresponds to a portion not doped with a dopant such as niobium and tantalum. Thus, the coating layer and the core material particle can be easily distinguished.

In the metal oxide particle coated with Nb/Ta-doped tin oxide (composite particles) used in the present invention, preferably 90 to 100% by mass, and more preferably 100% by mass of the dopant (niobium, tantalum) with which the particle is doped exist in 60% by mass of the surface side region of the particle (composite particle).

A coating liquid for a conductive layer can be prepared by dispersing the metal oxide particle coated with Nb/Ta-doped tin oxide together with a binder material in a solvent. Examples of a dispersion method include methods using a paint shaker, a sand mill, a ball mill, and a liquid collision type high-speed dispersing machine. The thus-prepared coating liquid for a conductive layer can be applied onto the support, and dried and/or cured to form a conductive layer.

From the viewpoint of improving resistance to leakage and suppressing increase in the residual potential, when a test which continuously applies a voltage having only the DC voltage (DC component) of −1.0 kV to the conductive layer (also referred to as a "DC voltage continuous application test") is performed, preferably, Ia and Ib satisfy relations (i) and (ii) below where, in the relation (i), Ia [μA] is the absolute value of the largest amount of the current flowing through the conductive layer, and, in the relation (ii), Ib [μA] is the absolute value of the amount of the current flowing through the conductive layer when the decrease rate per minute of the amount of the current flowing through the conductive layer reaches 1% or less for the first time. Details of the DC voltage continuous application test will be described later.

$$Ia \leq 6{,}000 \quad \text{(i)}$$

$$10 \leq Ib \quad \text{(ii)}$$

Hereinafter, Ia that is the absolute value of the largest amount of the current is also referred to as "the largest current amount Ia," and Ib that is the absolute value of the amount of the current is also referred to as the "current amount Ib."

If the largest current amount Ia of the current flowing through the conductive layer is more than 6,000 μA, the resistance to leakage of the electrophotographic photosensitive member is likely to reduce. In the conductive layer whose largest current amount Ia is more than 6,000 μA, it is thought that excessive current is likely to flow locally, causing breakdown that will lead to the leak. To further improve resistance to leakage, the largest current amount Ia is preferably not more than 5,000 μA $$(Ia \leq 5{,}000 \quad \text{(iii)}).$$

Meanwhile, if the current amount Ib of the current flowing through the conductive layer is less than 10 μA, the residual potential of the electrophotographic photosensitive member is likely to increase during image formation. In the conductive layer whose current amount Ib is less than 10 μA, it is thought that stagnation of a flow of charges is likely to occur, which stagnation will increase the residual potential. To further prevent the residual potential from increasing, the current amount Ib is preferably not less than 20 μA $$(20 \leq Ib \quad \text{(iv)}).$$

From the viewpoint of improving resistance to leakage or controlling the largest current amount Ia to be not more than 6,000 μA, the powder resistivity of the metal oxide particle coated with Nb/Ta-doped tin oxide used for the conductive layer is preferably not less than $1.0\times10^3$ Ω·cm.

If the powder resistivity of the metal oxide particle coated with Nb/Ta-doped tin oxide is less than $1.0\times10^3$ Ω·cm, the resistance to leakage of the electrophotographic photosensitive member is likely to reduce. This is probably that the state of the electric conductive path in the conductive layer formed by the metal oxide particle coated with Nb/Ta-doped tin oxide varies according to the powder resistivity of the metal oxide particle coated with Nb/Ta-doped tin oxide. If the powder resistivity of the metal oxide particle coated with Nb/Ta-doped tin oxide is less than $1.0\times10^3$ Ω·cm, the amount of charges flowing through individual metal oxide particle coated with Nb/Ta-doped tin oxide is likely to increase. Meanwhile, if the powder resistivity of the metal oxide particle coated with Nb/Ta-doped tin oxide is not less than $1.0\times10^3$ Ω·cm, the amount of charges flowing through individual metal oxide particle coated with Nb/Ta-doped tin oxide is likely to decrease. Specifically, in the conductive layer formed using the metal oxide particle coated with Nb/Ta-doped tin oxide whose powder resistivity is less than $1.0\times10^3$ Ω·cm and in the conductive layer formed using the metal oxide particle coated with Nb/Ta-doped tin oxide whose powder resistivity is not less than $1.0\times10^3$ Ω·cm, it is thought that the conductive layers having the same volume resistivity have the same total amount of charges flowing through the conductive layer. If the conductive layers have the same total amount of charges flowing through the conductive layer, the amount of charges flowing through individual metal oxide particle coated with Nb/Ta-doped tin oxide whose powder resistivity is less than $1.0\times10^3$ Ω·cm is different from that of charges flowing through individual metal oxide particle coated with Nb/Ta-doped tin oxide whose powder resistivity is not less than $1.0\times10^3$ Ω·cm.

This means that the number of electric conductive paths in the conductive layer is different between the conductive layer formed using the metal oxide particle coated with Nb/Ta-doped tin oxide whose powder resistivity is less than $1.0\times10^3$ Ω·cm and the conductive layer formed using the metal oxide particle coated with Nb/Ta-doped tin oxide whose powder resistivity is not less than $1.0\times10^3$ Ω·cm. Specifically, it is presumed that the conductive layer formed using the metal oxide particle coated with Nb/Ta-doped tin oxide whose powder resistivity is not less than $1.0\times10^3$ Ω·cm has a larger number of electric conductive paths in the conductive layer than that in the conductive layer formed using the metal oxide particle coated with Nb/Ta-doped tin oxide whose powder resistivity is less than $1.0\times10^3$ Ω·cm.

Then, it is thought that when the conductive layer is formed using the metal oxide particle coated with Nb/Ta-doped tin oxide whose powder resistivity is not less than $1.0\times10^3$ Ω·cm, the amount of charges flowing through one electric conductive path in the conductive layer is relatively small to prevent the excessive current from locally flowing through each of the electric conductive paths, leading to improvement in the resistance to leakage of the electrophotographic photosensitive member. To further improve resistance to leakage, the powder resistivity of the metal oxide particle coated with Nb/Ta-doped tin oxide used for the conductive layer is preferably not less than $3.0\times10^3$ Ω·cm.

From the viewpoint of suppressing increase in the residual potential or controlling the current amount Ib to be not less than 10 μA, the powder resistivity of the metal oxide particle coated with Nb/Ta-doped tin oxide used for the conductive layer is preferably not more than $1.0\times10^5$ Ω·cm.

If the powder resistivity of the metal oxide particle coated with Nb/Ta-doped tin oxide is more than $1.0\times10^5$ Ω·cm, the residual potential of the electrophotographic photosensitive member is likely to increase during image formation. The volume resistivity of the conductive layer is difficult to control to be not more than $5.0\times10^{12}$ Ω·cm. To further suppress increase in the residual potential, the powder resistivity of the metal oxide particle coated with Nb/Ta-doped tin oxide used for the conductive layer is preferably not more than $5.0\times10^4$ Ω·cm.

For these reasons, the powder resistivity of the metal oxide particle coated with Nb/Ta-doped tin oxide used for the conductive layer is preferably not less than $1.0\times10^3$ Ω·cm and not more than $1.0\times10^5$ Ω·cm, and more preferably not less than $3.0\times10^3$ Ω·cm and not more than $5.0\times10^4$ Ω·cm.

The metal oxide particle coated with Nb/Ta-doped tin oxide exhibit a larger improving effect on the resistance to leakage of the electrophotographic photosensitive member and a larger suppressing effect on increase in the residual potential during image formation than those of the titanium oxide ($TiO_2$) particle coated with oxygen-defective tin oxide ($SnO_2$) (hereinafter, also referred to as a "titanium oxide particle coated with oxygen-defective tin oxide"). The reason for the large improving effect on resistance to leakage is probably because the conductive layer using the metal oxide particle coated with Nb/Ta-doped tin oxide as the metal oxide particle has the largest current amount Ia smaller and pressure resistance larger than those in the conductive layer using the titanium oxide particle coated with oxygen-defective tin oxide. The reason for the large suppressing effect on increase in the residual potential during image formation is probably because the titanium oxide particle coated with oxygen-defective tin oxide oxidizes in the presence of oxygen, oxygen-defective sites in tin oxide ($SnO_2$) are lost, the resistance of the particle increases, and a flow of charges in the conductive layer is likely to stagnate; however, the metal oxide particle coated with Nb/Ta-doped tin oxide hardly show such behaviors.

The proportion (coating rate) of tin oxide ($SnO_2$) in the metal oxide particle coated with Nb/Ta-doped tin oxide is preferably 10 to 60% by mass. To control the coating rate of tin oxide ($SnO_2$), a tin raw material necessary for generation of tin oxide ($SnO_2$) needs to be blended during production of the metal oxide particle coated with Nb/Ta-doped tin oxide. For example, when tin chloride ($SnCl_4$) is used for the tin raw material, the tin raw material needs to be added in consideration of the amount of tin oxide ($SnO_2$) to be generated from tin chloride ($SnCl_4$). The coating rate in this case is the value calculated based on the mass of tin oxide ($SnO_2$) that forms the coating layer based on the total mass of tin oxide ($SnO_2$) that forms the coating layer and the metal oxide (such as titanium oxide, zirconium oxide, zinc oxide, and tin oxide) that forms the core material particle, without considering the mass of niobium or tantalum with which tin oxide ($SnO_2$) is doped. At a coating rate of tin oxide ($SnO_2$) less than 10% by mass, the powder resistivity of the metal oxide particle coated with Nb/Ta-doped tin oxide is difficult to control to be not more than $1.0\times10^5$ Ω·cm. At a coating rate of more than 60% by mass, the core material particle is likely to be coated with tin oxide ($SnO_2$) ununiformly, and cost is likely to increase. Additionally, the powder resistivity of the metal oxide particle coated with Nb/Ta-doped tin oxide is difficult to control to be not less than $1.0\times10^3$ Ω·cm.

The amount of niobium or tantalum with which tin oxide ($SnO_2$) is doped is preferably 0.1 to 10% by mass based on the mass of tin oxide ($SnO_2$) (mass not including the mass of niobium or tantalum). When the amount of niobium or tantalum with which tin oxide ($SnO_2$) is doped is less than 0.1% by mass, the powder resistivity of the metal oxide particle coated with Nb/Ta-doped tin oxide is difficult to control to be not more than $1.0\times10^5$ Ω·cm. When the amount of niobium or tantalum with which tin oxide ($SnO_2$) is doped is more than 10% by mass, the crystallinity of tin oxide ($SnO_2$) reduces, and the powder resistivity of the metal oxide particle coated with Nb/Ta-doped tin oxide is difficult to control to be not less than $1.0\times10^3$ Ω·cm (not more than $1.0\times10^5$ Ω·cm). Typically, by doping tin oxide ($SnO_2$) with niobium or tantalum, the powder resistivity of the particle can be lower than that in the case where tin oxide is not doped with niobium or tantalum.

The method for producing a titanium oxide particle coated with tin oxide doped with niobium or tantalum ($SnO_2$) is disclosed in Japanese Patent Application Laid-Open No. 2004-349167. The method for producing a tin oxide particle coated with tin oxide ($SnO_2$) is disclosed in Japanese Patent Application Laid-Open No. 2010-030886.

In the present invention, the method for measuring the powder resistivity of the metal oxide particle such as the metal oxide particle coated with Nb/Ta-doped tin oxide is as follows.

The powder resistivity of the metal oxide particle is measured under a normal temperature and normal humidity (23° C./50% RH) environment. In the present invention, as the measurement apparatus, a resistivity meter made by Mitsubishi Chemical Corporation (trade name: Loresta GP) was used. The metal oxide particles to be measured are solidified at a pressure of 500 kg/cm$^2$ into a pellet-like sample for measurement. The voltage to be applied is 100 V.

In the present invention, the particle having the core material particle formed of a metal oxide (metal oxide particle coated with Nb/Ta-doped tin oxide) is used for the conductive layer to improve the dispersibility of the metal oxide particle in the coating solution for a conductive layer. When the particle formed of only tin oxide doped with niobium or tantalum ($SnO_2$) is used, the particle diameter of the metal oxide particle in the coating solution for a conductive layer is likely to be increased. Such a large diameter of the particle may lead to projected defects produced on the surface of the conductive layer to reduce resistance to leakage or the stability of the coating solution for a conductive layer.

The metal oxide such as titanium oxide ($TiO_2$), zirconium oxide ($ZrO_2$), tin oxide ($SnO_2$), and zinc oxide (ZnO) is used as the material that forms the core material particle because resistance to leakage is easily improved. Another reason for use of the metal oxide is that the transparency of the particle is low, and defects on the surface of the support are easily covered. In contrast, when barium sulfate that is not a metal oxide is used as the material that forms the core material particle, for example, the amount of charges flowing through the conductive layer is likely to increase, and resistance to leakage is difficult to be improved. The transparency of the particle is high, and another material for covering the defects on the surface of the support may be needed separately.

Not the uncoated metal oxide particle but the metal oxide particle coated with tin oxide doped with niobium or tantalum ($SnO_2$) are used as the metal oxide particle because a flow of charges is likely to stagnate during image formation to increase residual potential in the uncoated metal oxide particle.

Examples of a binder material used for preparation of the coating liquid for a conductive layer include resins such as phenol resins, polyurethanes, polyamides, polyimides, polyamidimides, polyvinyl acetals, epoxy resins, acrylic resins, melamine resins, and polyesters. One of these or two or more thereof can be used. Among these resins, curable resins are preferable and thermosetting resins are more preferable from the viewpoint of suppressing migration (transfer) to other layer, adhesive properties to the support, the dispersibility and dispersion stability of the metal oxide particle coated with Nb/Ta-doped tin oxide, and resistance against a solvent after formation of the layer. Among the thermosetting resins, thermosetting phenol resins and thermosetting polyurethanes are preferable. In a case where a curable resin is used for the binder material for the conductive layer, the binder material contained in the coating liquid for a conductive layer is a monomer and/or oligomer of the curable resin.

Examples of a solvent used for the coating liquid for a conductive layer include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

In the present invention, the mass ratio (P/B) of the metal oxide particle coated with Nb/Ta-doped tin oxide (P) to the binder material (B) in the coating liquid for a conductive layer is preferably not less than 1.5/1.0 and not more than 3.5/1.0. At a mass ratio (P/B) less than 1.5/1.0, a flow of charges is likely to stagnate during image formation to increase residual potential. Additionally, the volume resistivity of the conductive layer is difficult to control to be not more than $5.0\times10^{12}$ Ω·cm. At a mass ratio (P/B) more than 3.5/1.0, the volume resistivity of the conductive layer is difficult to control to be not less than $1.0\times10^{8}$ Ω·cm. Additionally, the metal oxide particle coated with Nb/Ta-doped tin oxide is difficult to bind, leading to cracks of the conductive layer and difficulties in improving resistance to leakage.

From the viewpoint of covering the defects of the surface of the support, the film thickness of the conductive layer is preferably not less than 10 μm and not more than 40 μm, and more preferably not less than 15 μm and not more than 35 μm.

In the present invention, FISCHERSCOPE MMS made by Helmut Fischer GmbH was used as an apparatus for measuring the film thickness of each layer in the electrophotographic photosensitive member including a conductive layer.

The average particle diameter of the metal oxide particle coated with Nb/Ta-doped tin oxide in the coating solution for a conductive layer is preferably not less than 0.10 μm and not more than 0.45 μm, and more preferably not less than 0.15 μm and not more than 0.40 μm. At an average particle diameter less than 0.10 μm, the metal oxide particle coated with Nb/Ta-doped tin oxide may aggregate again after preparation of the coating solution for a conductive layer to reduce the stability of the coating solution for a conductive layer or crack the surface of the conductive layer. At an average particle diameter more than 0.45 μm, the surface of the conductive layer may roughen, charges are likely to be locally injected into the photosensitive layer, and remarkable black spots may be produced in a white solid portion in an output image.

The average particle diameter of the metal oxide particle such as the metal oxide particle coated with Nb/Ta-doped tin oxide in the coating solution for a conductive layer can be measured as follows by a liquid phase sedimentation method.

First, the coating solution for a conductive layer is diluted with the solvent used for preparation of the coating solution such that the transmittance is between 0.8 and 1.0. Next, using an ultracentrifugal auto particle size distribution measurement apparatus, the histogram of the average particle diameter of the metal oxide particle (volume-based D50) and the particle size distribution is created. In the present invention, as the ultracentrifugal auto particle size distribution measurement apparatus, an ultracentrifugal auto particle size distribution measurement apparatus made by HORIBA, Ltd. (trade name: CAPA700) was used, and measurement was performed under the condition of the number of rotation of 3,000 rpm.

In order to suppress interference fringes produced on the output image by interference of the light reflected on the surface of the conductive layer, the coating liquid for a conductive layer may contain a surface roughening material for roughening the surface of the conductive layer. As the surface roughening material, resin particles having the average particle diameter of not less than 1 μm and not more than 5 μm are preferable. Examples of the resin particles include particles of curable resins such as curable rubbers, polyurethanes, epoxy resins, alkyd resins, phenol resins, polyesters, silicone resins, and acrylic-melamine resins. Among these, particles of silicone resins difficult to aggregate are preferable. The specific gravity of the resin particle (0.5 to 2) is smaller than that of the metal oxide particle coated with Nb/Ta-doped tin oxide (4 to 7). For this reason, the surface of the conductive layer is efficiently roughened at the time of forming the conductive layer. However, as the content of the surface roughening material in the conductive layer is larger, the volume resistivity of the conductive layer is likely to be increased. Accordingly, in order to adjust the volume resistivity of the conductive layer in the range of not more than $5.0\times10^{12}$ Ω·cm, the content of the surface roughening material in the coating liquid for a conductive layer is preferably 1 to 80% by mass based on the binder material in the coating liquid for a conductive layer.

The coating liquid for a conductive layer may also contain a leveling agent for increasing surface properties of the conductive layer. The coating liquid for a conductive layer may also contain pigment particles for improving covering properties to the conductive layer.

In order to prevent charge injection from the conductive layer to the photosensitive layer, an undercoat layer (barrier layer) having electrical barrier properties may be provided between the conductive layer and the photosensitive layer.

The undercoat layer can be formed by applying a coating solution for an undercoat layer containing a resin (binder resin) onto the conductive layer, and drying the applied solution.

Examples of the resin (binder resin) used for the undercoat layer include water soluble resins such as polyvinyl alcohol, polyvinyl methyl ether, polyacrylic acids, methyl cellulose, ethyl cellulose, polyglutamic acid, casein, and starch, polyamides, polyimides, polyamidimides, polyamic acids, melamine resins, epoxy resins, polyurethanes, and polyglutamic acid esters. Among these, in order to produce electrical barrier properties of the undercoat layer effectively, thermoplastic resins are preferable. Among the thermoplastic resins, thermoplastic polyamides are preferable. As polyamides, copolymerized nylons are preferable.

The film thickness of the undercoat layer is preferably not less than 0.1 μm and not more than 2 μm.

In order to prevent a flow of charges from stagnating in the undercoat layer, the undercoat layer may contain an electron transport substance (electron-receptive substance such as an acceptor). Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

On the conductive layer or undercoat layer, the photosensitive layer is provided.

Examples of the charge-generating substance used for the photosensitive layer include azo pigments such as monoazos, disazos, and trisazos; phthalocyanine pigments such as metal phthalocyanine and non-metallic phthalocyanine; indigo pigments such as indigo and thioindigo; perylene pigments such as perylene acid anhydrides and perylene acid imides; polycyclic quinone pigments such as anthraquinone and pyrenequinone; squarylium dyes; pyrylium salts and thiapyrylium salts; triphenylmethane dyes; quinacridone pigments; azulenium salt pigments; cyanine dyes; xanthene dyes; quinoneimine dyes; and styryl dyes. Among these, metal phthalocyanines such as oxytitanium phthalocyanine, hydroxy gallium phthalocyanine, and chlorogallium phthalocyanine are preferable.

In a case where the photosensitive layer is a laminated photosensitive layer, a coating solution for a charge-generating layer prepared by dispersing a charge-generating substance and a binder resin in a solvent can be applied and dried to form a charge-generating layer. Examples of the dispersion method include methods using a homogenizer, an ultrasonic wave, a ball mill, a sand mill, an attritor, or a roll mill.

Examples of the binder resin used for the charge-generating layer include polycarbonates, polyesters, polyarylates, butyral resins, polystyrenes, polyvinyl acetals, diallyl phthalate resins, acrylic resins, methacrylic resins, vinyl acetate resins, phenol resins, silicone resins, polysulfones, styrene-butadiene copolymers, alkyd resins, epoxy resins, urea resins, and vinyl chloride-vinyl acetate copolymers. One of these can be used alone, or two or more thereof can be used as a mixture or a copolymer.

The proportion of the charge-generating substance to the binder resin (charge-generating substance:binder resin) is preferably in the range of 10:1 to 1:10 (mass ratio), and more preferably in the range of 5:1 to 1:1 (mass ratio).

Examples of the solvent used for the coating solution for a charge-generating layer include alcohols, sulfoxides, ketones, ethers, esters, aliphatic halogenated hydrocarbons, and aromatic compounds.

The film thickness of the charge-generating layer is preferably not more than 5 μm, and more preferably not less than 0.1 μm and not more than 2 μm.

To the charge-generating layer, a variety of additives such as a sensitizer, an antioxidant, an ultraviolet absorbing agent, and a plasticizer can be added when necessary. In order to prevent a flow of charges from stagnating in the charge-generating layer, the charge-generating layer may contain an electron transport substance (an electron-receptive substance such as an acceptor). Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

Examples of the charge transport substance used for the photosensitive layer include triarylamine compounds, hydrazone compounds, styryl compounds, stilbene compounds, pyrazoline compounds, oxazole compounds, thiazole compounds, and triallylmethane compounds.

In a case where the photosensitive layer is a laminated photosensitive layer, a coating solution for a charge transport layer prepared by dissolving the charge transport substance and a binder resin in a solvent can be applied and dried to form a charge transport layer.

Examples of the binder resin used for the charge transport layer include acrylic resins, styrene resins, polyesters, polycarbonates, polyarylates, polysulfones, polyphenylene oxides, epoxy resins, polyurethanes, alkyd resins, and unsaturated resins. One of these can be used alone, or two or more thereof can be used as a mixture or a copolymer.

The proportion of the charge transport substance to the binder resin (charge transport substance:binder resin) is preferably in the range of 2:1 to 1:2 (mass ratio).

Examples of the solvent used for the coating solution for a charge transport layer include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted by a halogen atom such as chlorobenzene, chloroform, and carbon tetrachloride.

From the viewpoint of charging uniformity and reproductivity of an image, the film thickness of the charge transport layer is preferably not less than 3 μm and not more than 40 μm, and more preferably not less than 4 μm and not more than 30 μm.

To the charge transport layer, an antioxidant, an ultraviolet absorbing agent, and a plasticizer can be added when necessary.

In a case where the photosensitive layer is a single photosensitive layer, a coating solution for a single photosensitive layer containing a charge-generating substance, a charge transport substance, a binder resin, and a solvent can be applied and dried to form a single photosensitive layer. As the charge-generating substance, the charge transport substance, the binder resin, and the solvent, a variety of the materials described above can be used, for example.

On the photosensitive layer, a protective layer may be provided to protect the photosensitive layer.

A coating solution for a protective layer containing a resin (binder resin) can be applied and dried and/or cured to form a protective layer.

The film thickness of the protective layer is preferably not less than 0.5 μm and not more than 10 μm, and more preferably not less than 1 μm and not more than 8 μm.

In application of the coating solutions for the respective layers above, application methods such as a dip coating method (an immersion coating method), a spray coating method, a spin coating method, a roll coating method, a Meyer bar coating method, and a blade coating method can be used.

Figure 1:
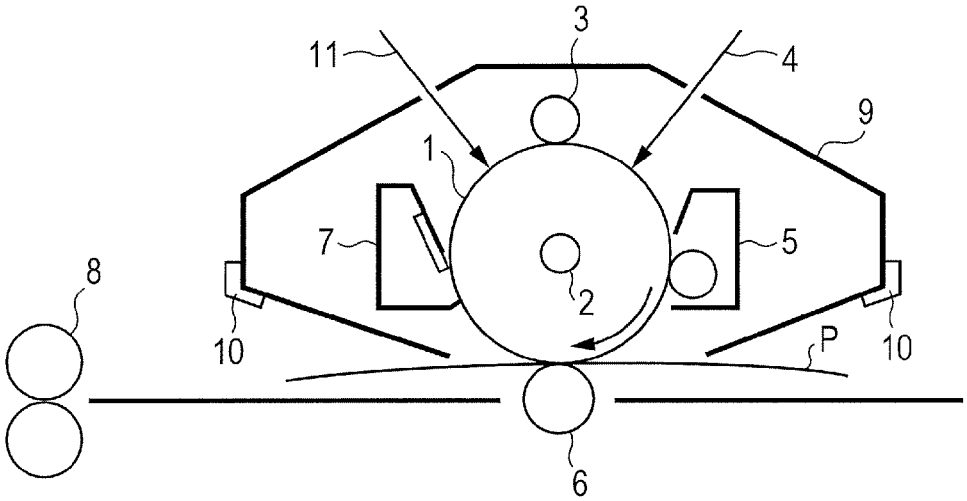
FIG. 1 is a drawing illustrating an example of a schematic configuration of an electrophotographic apparatus including a process cartridge having an electrophotographic photosensitive member of the present invention.

FIG. 1 illustrates an example of a schematic configuration of an electrophotographic apparatus including a process cartridge having an electrophotographic photosensitive member of the present invention.

In FIG. 1, a drum type (cylindrical) electrophotographic photosensitive member 1 is rotated and driven around a shaft 2 in the arrow direction at a predetermined circumferential speed.

The circumferential surface of the electrophotographic photosensitive member 1 rotated and driven is uniformly charged at a predetermined positive or negative potential by a charging unit (a primary charging unit, a charging roller, or the like) 3. Next, the circumferential surface of the electrophotographic photosensitive member 1 receives exposure light (image exposure light) 4 output from an exposing unit such as slit exposure or laser beam scanning exposure (not illustrated). Thus, an electrostatic latent image corresponding to a target image is sequentially formed on the circumferential surface of the electrophotographic photosensitive member 1. The voltage applied to the charging unit 3 may be only DC voltage, or DC voltage on which AC voltage is superimposed.

The electrostatic latent image formed on the circumferential surface of the electrophotographic photosensitive member 1 is developed by a toner of a developing unit 5 to form a toner image. Next, the toner image formed on the circumferential surface of the electrophotographic photosensitive member 1 is transferred onto a transfer material (such as paper) P by a transfer bias from a transferring unit (such as a transfer roller) 6. The transfer material P is fed from a transfer material feeding unit (not illustrated) between the electrophotographic photosensitive member 1 and the transferring unit 6 (contact region) in synchronization with rotation of the electrophotographic photosensitive member 1.

The transfer material P having the toner image transferred is separated from the circumferential surface of the electrophotographic photosensitive member 1, and introduced to a fixing unit 8 to fix the image. Thereby, an image forming product (print, copy) is printed out of the apparatus.

From the circumferential surface of the electrophotographic photosensitive member 1 after transfer of the toner image, the remaining toner of transfer is removed by a cleaning unit (such as a cleaning blade) 7. Further, the circumferential surface of the electrophotographic photosensitive member 1 is discharged by pre-exposure light 11 from a pre-exposing unit (not illustrated), and is repeatedly used for image formation. In a case where the charging unit is a contact charging unit such as a charging roller, the pre-exposure is not always necessary.

The electrophotographic photosensitive member 1 and at least one component selected from the charging unit 3, the developing unit 5, the transferring unit 6, and the cleaning unit 7 may be accommodated in a container and integrally supported as a process cartridge, and the process cartridge may be detachably attached to the main body of the electrophotographic apparatus. In FIG. 1, the electrophotographic photosensitive member 1, the charging unit 3, the developing unit 5, and the cleaning unit 7 are integrally supported to form a process cartridge 9, which is detachably attached to the main body of the electrophotographic apparatus using a guide unit 10 such as a rail in the main body of the electrophotographic apparatus. Moreover, the electrophotographic apparatus may include the electrophotographic photosensitive member 1, the charging unit 3, the exposing unit, the developing unit 5, and the transferring unit 6.

Next, using FIGS. 5 and 6, the above DC voltage continuous application test will be described.

The DC voltage continuous application test is performed under a normal temperature and normal humidity (23° C./50% RH) environment.

Figure 5:
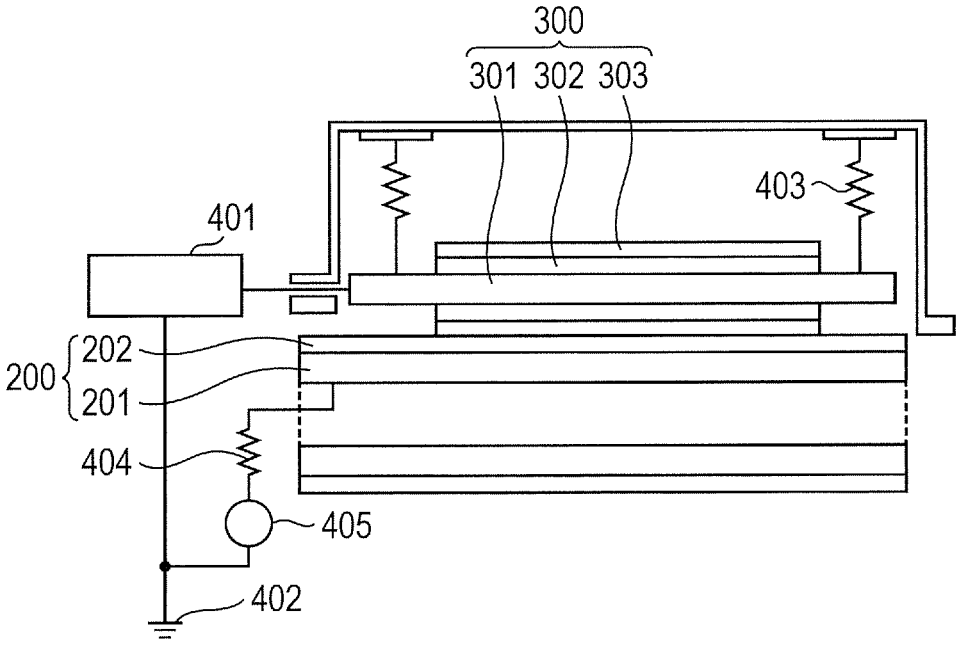
FIG. 5 is a drawing for describing a test which continuously applies a voltage having only a DC component of −1.0 kV to a conductive layer.

FIG. 5 is a drawing for describing the DC voltage continuous application test.

Figure 8:
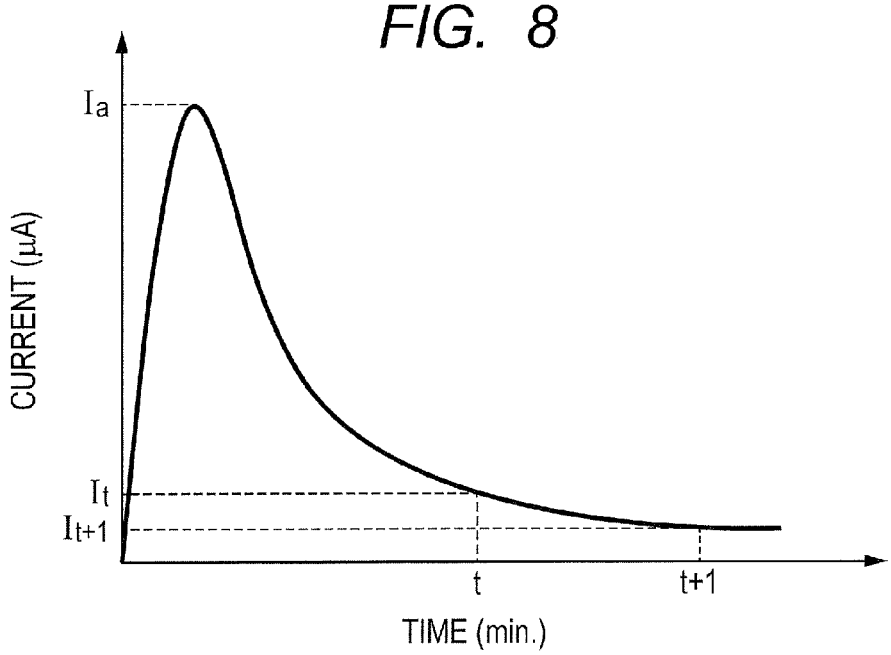
FIG. 8 is a drawing for describing Ia [μA] and Ib [μA].

First, a sample 200 in which only a conductive layer 202 is formed on a support 201 or in which only the conductive layer 202 is left on the support 201 by removing layers on the conductive layer 202 from the electrophotographic photosensitive member (hereinafter, also referred to as a "test sample") is brought into contact with a conductive roller 300 having a core metal 301, an elastic layer 302, and a surface layer 303 such that the axis of the sample is parallel to that of the conductive roller. At this time, a load of 500 g is applied to each of the ends of the core metal 301 in the conductive roller 300 with a spring 403. The core metal 301 of the conductive roller 300 is connected to a DC power supply 401, and the support 201 in the test sample 200 is connected to a ground 402. A constant voltage having only the DC voltage (DC component) of −1.0 kV is continuously applied to the conductive roller 300 such that the decrease rate per minute of the amount of the current flowing through the conductive layer reaches 1% or less for the first time. Thus, the voltage having only the DC voltage of −1.0 kV is continuously applied to the conductive layer 202. In FIG. 5, a resistance 404 (100 kΩ) and an ammeter 405 are illustrated. Typically, the absolute value of the current amount reaches the largest current amount Ia immediately after the voltage is applied. Subsequently, the absolute value of the current amount decreases. The degree of the decrease becomes mild gradually, and finally reaches the saturated region (in which the decrease rate per minute of the amount of the current flowing through the conductive layer is 1% or less). Wherein a time after the voltage is applied is t [min], a time after 1 minute later is t+1 [min], the absolute value of the current amount at t [min] is $I_t$ [μA], and the absolute value of the current amount at t+1 [min] is $I_{t+1}$ [μA], when the value of $\{(I_t-I_{t+1})/I_t\}\times 100$ reaches 1 or less (1% or less) for the first time, t+1 is the time when the "decrease rate per minute of the amount of the current flowing through the conductive layer reaches 1% or less for the first time." The relationship is shown in FIG. 8. In this case, $Ib=I_{t+1}$.

Figure 6:
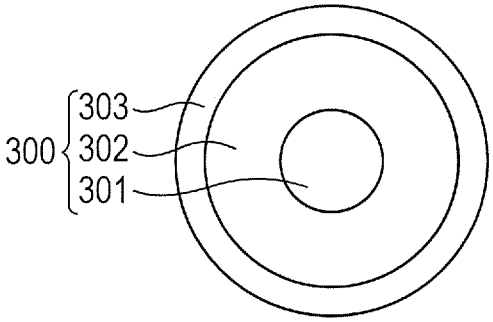
FIG. 6 is a drawing schematically illustrating a configuration of a conductive roller.

FIG. 6 is a drawing schematically illustrating the configuration of the conductive roller 300 used for the test.

The conductive roller 300 includes the surface layer 303 having a middle resistance for controlling the resistance of the conductive roller 300, the conductive elastic layer 302 having elasticity necessary for forming a uniform nip between the conductive roller 300 and the surface of the test sample 200, and the core metal 301.

To continuously apply the voltage having only a DC component of −1.0 kV to the conductive layer 202 in the test sample 200 stably, the nip between the test sample 200 and the conductive roller 300 needs to be kept constant. To keep the nip constant, the hardness of the elastic layer 302 in the conductive roller 300 and the strength of the spring 403 may be properly adjusted. Besides, a mechanism for adjusting the nip may be provided.

The conductive roller 300 produced as follows was used. Hereinafter, "parts" mean "parts by mass."

For the core metal 301, a stainless steel core metal having a diameter of 6 mm was used.

Next, the elastic layer 302 was formed on the core metal 301 by the following method.

The materials shown below were kneaded for 10 minutes using an air-tight mixer whose temperature was controlled to be 50° C. Thus, a raw material compound was prepared. epichlorohydrin rubber ternary copolymer (epichlorohydrin: ethylene oxide:allyl glycidyl ether=40 mol %:56 mol %:4 mol %); 100 parts calcium carbonate (light); 30 parts aliphatic polyester (plasticizer); 5 parts zinc stearate; 1 part 2-mercaptobenzimidazole (antioxidant); 0.5 parts zinc oxide; 5 parts quaternary ammonium salt represented by the following formula; 2 parts

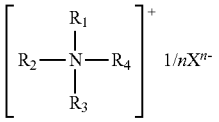

$R_1 = CH_3(CH_2)_6CH_2$
$R_2 = CH_3$
$R_3 = CH_3$
$R_4 = CH_2CH_2OH$
$X = ClO_4$
$n = 1$ carbon black (product not surface treated, average particle diameter: 0.2 μm, powder resistivity: 0.1 Ω·cm); 5 parts 1 part of sulfur as a vulcanizing agent, 1 part of dibenzothiazyl sulfide as a vulcanization accelerator, and 0.5 parts of tetramethylthiuram monosulfide based on 100 parts of the epichlorohydrin rubber ternary copolymer as a raw material rubber were added to the compound, and kneaded for 10 minutes using a twin-roll mill cooled to 20° C.

The compound obtained by this kneading was molded into a roller shape having an outer diameter of 15 mm on the core metal 301 using an extrusion molding machine, and heated and steam vulcanized. Then, the obtained product was polished to have an outer diameter of 10 mm. Thus, an elasticity roller having the elastic layer 302 formed on the core metal 301 was obtained. At this time, a wide polishing method was used for the polishing. The length of the elasticity roller was 232 mm.

Next, the surface layer 303 was applied onto and formed on the elastic layer 302 by the following method.

Using the materials shown below, a mixed solution was prepared in a glass bottle as a container:

Caprolactone-modified acrylic polyol solution; 100 parts,

Methyl isobutyl ketone; 250 parts,

Conductive tin oxide ($SnO_2$) (product treated with trifluoropropyltrimethoxysilane, average particle diameter: 0.05 μm, powder resistivity: $1\times10^3$Ω·cm); 250 parts, Hydrophobic silica (product treated with dimethylpolysiloxane, average particle diameter: 0.02 μm, powder resistivity: $1\times10^{16}$)·cm); 3 parts, Modified dimethylsilicone oil; 0.08 parts, and Crosslinked PMMA particle (average particle diameter: 4.98 μm); 80 parts.

The mixed solution was placed in a paint shaker dispersing machine. The paint shaker dispersing machine was filled with glass beads having an average particle diameter of 0.8 mm as a dispersion medium at a filling rate of 80%. The mixed solution was dispersed for 18 hours to prepare a dispersion solution.

A mixture of a butanone oxime blocked hexamethylene diisocyanate (HDI) and butanone oxime blocked isophorone diisocyanate (IPDI) at 1:1 by mass ratio was added to the dispersion solution at NCO/OH =1.0, and a coating solution for a surface layer was prepared.

The coating solution for a surface layer was applied onto the elastic layer 302 in the elasticity roller by dipping twice, dried by air, and dried at 160° C. for 1 hour to form the surface layer 303.

Thus, the conductive roller 300 including the core metal 301, the elastic layer 302, and the surface layer 303 was produced. The resistance of the conductive roller produced was measured as follows. The resistance was $1.0\times10^5$Ω.

Figure 7:
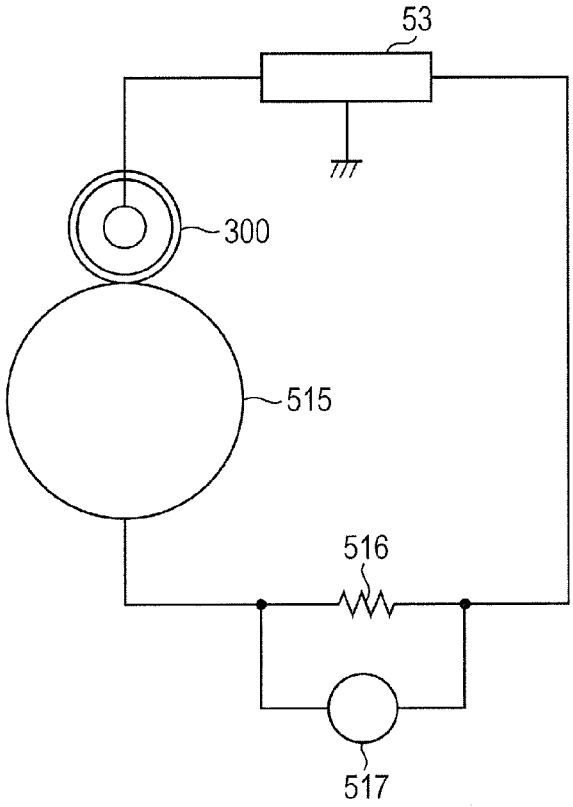
FIG. 7 is a drawing for describing a method for measuring the resistance of the conductive roller.

FIG. 7 is a drawing for describing a method for measuring the resistance of the conductive roller.

The resistance of the conductive roller is measured under normal temperature and normal humidity (23° C./50% RH) environment. The stainless steel cylindrical electrode 515 is brought into contact with the conductive roller 300 such that the axis of the cylindrical electrode is parallel to that of the conductive roller. At this time, a load of 500 g is applied to each of the ends of the core metal in the conductive roller (not illustrated). The cylindrical electrode 515 having the same outer diameter as that of the test sample is selected and used. To keep this contact state, the cylindrical electrode 515 is driven and rotated at the number of rotation of 200 rpm, the conductive roller 300 is rotated following the cylindrical electrode 515 at the same rate, and a voltage of −200 V is applied to the cylindrical electrode 515 from an external power supply 53. At this time, the resistance calculated from the value of the current flowing through the conductive roller 300 is defined as the resistance of the conductive roller 300. In FIG. 7, a resistance 516 and a recorder 517 are illustrated.

Hereinafter, using specific Examples, the present invention will be described more in detail. However, the present invention will not be limited to these. In Examples and Comparative Examples, "parts" mean "parts by mass."

Among the metal oxide particle coated with a variety of tin oxides used in Examples and Comparative Examples, all the titanium oxide particles having a core material particle of a titanium oxide particle (core material particles) are spherical particles produced by the sulfuric acid method and having a purity of 98.0% and a BET value of 7.2 $m^2$/g. All the metal oxide particle having a core material particle of a titanium oxide particle and coated with a variety of tin oxides (composite particles) have a coating rate of 45% by mass. Among the metal oxide particle coated with a variety of tin oxides and having a core material particle of a titanium oxide particle (composite particles), the particle having a powder resistivity of $5.0\times10^2$ Ω·cm has a BET value of 25.0 $m^2$/g. Among the metal oxide particle coated with a variety of tin oxides and having a core material particle of a titanium oxide particle (composite particles), the particle having a powder resistivity of $1.0\times10^3$ Ω·cm has a BET value of 26.0 $m^2$/g. Among the metal oxide particle coated with a variety of tin oxides and having a core material particle of a titanium oxide particle (composite particles), the particle having a powder resistivity of $3.0\times10^3$ Ω·cm has a BET value of 26.5 $m^2$/g. Among the metal oxide particle coated with a variety of tin oxides and having a core material particle of a titanium oxide particle (composite particles), the particle having a powder resistivity of $5.0\times10^3$ Ω·cm has a BET value of 27.0 $m^2$/g. Among the metal oxide particle coated with a variety of tin oxides and having a core material particle of a titanium oxide particle (composite particles), the particle having a powder resistivity of $1.0\times10^4$ Ω·cm has a BET value of 28.0 $m^2$/g. Among the metal oxide particle coated with a variety of tin oxides and having a core material particle of a titanium oxide particle (composite particles), the particle having a powder resistivity of $5.0\times10^4$ Ω·cm has a BET value of 29.0 $m^2/g$. Among the metal oxide particle coated with a variety of tin oxides and having a core material particle of a titanium oxide particle (composite particles), the particle having a powder resistivity of $1.0\times10^5$ Ω·cm has a BET value of 30.0 $m^2/g$. Among the metal oxide particle coated with a variety of tin oxides and having a core material particle of a titanium oxide particle (composite particles), the particle having a powder resistivity of $5.0\times10^5$ Ω·cm has a BET value of 30.5 $m^2/g$.

Among the metal oxide particle coated with a variety of tin oxides used in Examples and Comparative Examples, all the tin oxide particles having a core material particle of a tin oxide particle (core material particles) are spherical particles having a purity of 99.9% and a BET value of 9.5 $m^2/g$. All the metal oxide particle having a core material particle of a tin oxide particle and coated with a variety of tin oxides (composite particles) have a coating rate of 40% by mass. Among the metal oxide particle having a core material particle of a tin oxide particle and coated with a variety of tin oxides (composite particles), the particle having a powder resistivity of $5.0\times10^2$ Ω·cm has a BET value of 28.0 $m^2/g$. Among the metal oxide particle having a core material particle of a tin oxide particle and coated with a variety of tin oxides (composite particles), the particle having a powder resistivity of $1.0\times10^3$ Ω·cm has a BET value of 29.0 $m^2/g$. Among the metal oxide particle having a core material particle of a tin oxide particle and coated with a variety of tin oxides (composite particles), the particle having a powder resistivity of $3.0\times10^3$ Ω·cm has a BET value of 29.5 $m^2/g$. Among the metal oxide particle having a core material particle of a tin oxide particle and coated with a variety of tin oxides (composite particles), the particle having a powder resistivity of $5.0\times10^3$ Ω·cm has a BET of 30.0 $m^2/g$. Among the metal oxide particle having a core material particle of a tin oxide particle and coated with a variety of tin oxides (composite particles), the particle having a powder resistivity of $1.0\times10^4$ Ω·cm has a BET value of 31.0 $m^2/g$. Among the metal oxide particle having a core material particle of a tin oxide particle and coated with a variety of tin oxides (composite particles), the particle having a powder resistivity of $5.0\times10^4$ Ω·cm has a BET value of 32.0 $m^2/g$. Among the metal oxide particle having a core material particle of a tin oxide particle and coated with a variety of tin oxides (composite particles), the particle having a powder resistivity of $1.0\times10^5$ Ω·cm has a BET value of 33.0 $m^2/g$. Among the metal oxide particle having a core material particle of a tin oxide particle and coated with a variety of tin oxides (composite particles), the particle having a powder resistivity of $5.0\times10^5$ Ω·cm has a BET value of 33.5 $m^2/g$.

Among the metal oxide particle coated with a variety of tin oxides used in Examples and Comparative Examples, all the zinc oxide particles having a core material particle of a zinc oxide particle (core material particles) are spherical particles having a purity of 98.0% and a BET value of 8.3 $m^2/g$. All the metal oxide particle having a core material particle of a zinc oxide particle and coated with a variety of tin oxides (composite particles) have a coating rate of 37% by mass. Among the metal oxide particle having a core material particle of a zinc oxide particle and coated with a variety of tin oxides (composite particles), the particle having a powder resistivity of $5.0\times10^2$ Ω·cm has a BET value of 26.0 $m^2/g$. Among the metal oxide particle having a core material particle of a zinc oxide particle and coated with a variety of tin oxides (composite particles), the particle having a powder resistivity of $1.0\times10^3$ Ω·cm has a BET value of 27.0 $m^2/g$. Among the metal oxide particle having a core material particle of a zinc oxide particle and coated with a variety of tin oxides (composite particles), the particle having a powder resistivity of $3.0\times10^3$ Ω·cm has a BET value of 27.5 $m^2/g$. Among the metal oxide particle having a core material particle of a zinc oxide particle and coated with a variety of tin oxides (composite particles), the particle having a powder resistivity of $5.0\times10^3$ Ω·cm has a BET value of 28.0 $m^2/g$. Among the metal oxide particle having a core material particle of a zinc oxide particle and coated with a variety of tin oxides (composite particles), the particle having a powder resistivity of $1.0\times10^4$ Ω·cm has a BET value of 29.0 $m^2/g$. Among the metal oxide particle having a core material particle of a zinc oxide particle and coated with a variety of tin oxides (composite particles), the particle having a powder resistivity of $5.0\times10^4$ Ω·cm has a BET value of 30.0 $m^2/g$. Among the metal oxide particle having a core material particle of a zinc oxide particle and coated with a variety of tin oxides (composite particles), the particle having a powder resistivity of $1.0\times10^5$ Ω·cm has a BET value of 31.0 $m^2/g$. Among the metal oxide particle having a core material particle of a zinc oxide particle and coated with a variety of tin oxides (composite particles), the particle having a powder resistivity of $5.0\times10^5$ Ω·cm has a BET value of 31.5 $m^2/g$.

Among the metal oxide particle coated with a variety of tin oxides used in Examples, all the zirconium oxide particles having a core material particle of a zirconium oxide particle (core material particles) are spherical particles having a purity of 99.0% and a BET value of 8.3 $m^2/g$. All the metal oxide particle having a core material particle of a zirconia oxide particle and coated with a variety of tin oxides (composite particles) have a coating rate of 36% by mass. Among the metal oxide particle having a core material particle of a zirconia oxide particle and coated with a variety of tin oxides (composite particles), the particle having a powder resistivity of $1.0\times10^3$ Ω·cm has a BET value of 27.0 $m^2/g$. Among the metal oxide particle having a core material particle of a zirconia oxide particle and coated with a variety of tin oxides (composite particles), the particle having a powder resistivity of $1.0\times10^5$ Ω·cm has a BET value of 31.0 $m^2/g$.

The titanium oxide particle coated with tin oxide doped with niobium that was used in the coating solution for a conductive layer 1 below (composite particles) is obtained by burning the particles at a burning temperature of 650° C. As the burning temperature is raised, the powder resistivities of the metal oxide particle coated with a variety of tin oxides (composite particles) tend to reduce, and the BET values thereof tend to reduce. The powder resistivities of the metal oxide particle coated with a variety of tin oxides (composite particles) that were used in Examples and Comparative Examples were also adjusted by changing the burning temperature.

In Examples and Comparative Examples, the tin oxide is "$SnO_2$," titanium oxide is "$TiO_2$," zinc oxide is "ZnO," and zirconium oxide is "$ZrO_2$."

<Preparation Examples of Coating Solution for Conductive Layer>

(Preparation Example of Coating Solution for Conductive Layer 1)

207 parts of a titanium oxide ($TiO_2$) particle (powder resistivity: $1.0\times10^3$ Ω·cm, average primary particle diameter: 250 nm) coated with tin oxide ($SnO_2$) doped with niobium as the metal oxide particle, 144 parts of a phenol resin as a binder material (monomer/oligomer of the phenol resin) (trade name: Plyophen J-325, made by DIC Corporation, resin solid content: 60% by mass), and 98 parts of 1-methoxy-2-propanol as a solvent were placed in a sand mill using 450 parts of glass beads having a diameter of 0.8 mm, and dispersed under the conditions of the number of rotation: 2,000 rpm, the dispersion treatment time: 2.5 hours, and the setting temperature of cooling water: 18° C. Thus, a dispersion liquid was obtained.

The glass beads were removed from the dispersion liquid with a mesh. Then, 13.8 parts of a silicone resin particle as a surface roughening material (trade name: Tospearl 120, made by Momentive Performance Materials Inc. (the former GE Toshiba Silicone Co., Ltd.), average particle diameter: 2 μm), 0.014 parts of a silicone oil as a leveling agent (trade name: SH28PA, made by Dow Corning Toray Co., Ltd. (the former Dow Corning Toray Silicone Co., Ltd.)), 6 parts of methanol, and 6 parts of 1-methoxy-2-propanol were added to the dispersion liquid, and stirred to prepare a coating solution for a conductive layer 1.

The average particle diameter of metal oxide particles in the coating solution for a conductive layer 1 (titanium oxide ($TiO_2$) particle coated with tin oxide ($SnO_2$) doped with niobium) was 0.29 μm.

(Preparation Examples of Coating Solutions for a Conductive Layer 2 ) to 110 and C1 to C101

Coating solutions for a conductive layer 2 to 110 and C1 to C101 were prepared by the same operation as that in Preparation Example of the coating solution for a conductive layer 1 except that the kind, powder resistivity, and amount (parts) of the metal oxide particle used in preparation of the coating solution for a conductive layer, the amount (parts) of the phenol resin as the binder material (monomer/oligomer of the phenol resin), and the dispersion treatment time were changed as shown in Tables 1 to 9. The average particle diameters of the metal oxide particle in the coating solutions for a conductive layer 2 to 110 and C1 to C101 are shown in Tables 1 to 9.

TABLE 1

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| 1 | Titanium oxide particle | $1.0 \times 10^3$ | 207 | 144 | 2.5 | 2.4/1 | 0.29 |
| 2 | coated with tin oxide | $3.0 \times 10^3$ | 207 | 144 | 2.5 | 2.4/1 | 0.29 |
| 3 | doped with niobium | $1.0 \times 10^4$ | 207 | 144 | 2.5 | 2.4/1 | 0.29 |
| 4 | (Average primary particle | $5.0 \times 10^4$ | 207 | 144 | 2.5 | 2.4/1 | 0.29 |
| 5 | diameter: 250 nm) | $1.0 \times 10^5$ | 207 | 144 | 2.5 | 2.4/1 | 0.29 |
| 6 | | $1.0 \times 10^3$ | 228 | 109 | 2.5 | 3.5/1 | 0.31 |
| 7 | | $3.0 \times 10^3$ | 228 | 109 | 2.5 | 3.5/1 | 0.31 |
| 8 | | $5.0 \times 10^4$ | 228 | 109 | 2.5 | 3.5/1 | 0.31 |
| 9 | | $1.0 \times 10^5$ | 228 | 109 | 2.5 | 3.5/1 | 0.31 |
| 10 | | $1.0 \times 10^3$ | 176 | 195 | 2.5 | 1.5/1 | 0.27 |
| 11 | | $3.0 \times 10^3$ | 176 | 195 | 2.5 | 1.5/1 | 0.27 |
| 12 | | $5.0 \times 10^4$ | 176 | 195 | 2.5 | 1.5/1 | 0.27 |
| 13 | | $1.0 \times 10^5$ | 176 | 195 | 2.5 | 1.5/1 | 0.27 |
| 14 | | $5.0 \times 10^3$ | 207 | 144 | 1 | 2.4/1 | 0.33 |
| 15 | | $5.0 \times 10^3$ | 207 | 144 | 4 | 2.4/1 | 0.27 |
| 16 | | $1.0 \times 10^3$ | 228 | 109 | 1.5 | 3.5/1 | 0.35 |
| 17 | | $1.0 \times 10^5$ | 176 | 195 | 3.5 | 1.5/1 | 0.26 |
| 18 | Titanium oxide particle | $1.0 \times 10^3$ | 207 | 144 | 2.5 | 2.4/1 | 0.30 |
| 19 | coated with tin oxide | $3.0 \times 10^3$ | 207 | 144 | 2.5 | 2.4/1 | 0.30 |
| 20 | doped with tantalum | $1.0 \times 10^4$ | 207 | 144 | 2.5 | 2.4/1 | 0.30 |
| 21 | (Average primary particle | $5.0 \times 10^4$ | 207 | 144 | 2.5 | 2.4/1 | 0.30 |
| 22 | diameter: 250 nm) | $1.0 \times 10^5$ | 207 | 144 | 2.5 | 2.4/1 | 0.30 |
| 23 | | $1.0 \times 10^3$ | 228 | 109 | 2.5 | 3.5/1 | 0.32 |
| 24 | | $3.0 \times 10^3$ | 228 | 109 | 2.5 | 3.5/1 | 0.32 |
| 25 | | $5.0 \times 10^4$ | 228 | 109 | 2.5 | 3.5/1 | 0.32 |
| 26 | | $1.0 \times 10^5$ | 228 | 109 | 2.5 | 3.5/1 | 0.32 |
| 27 | | $1.0 \times 10^3$ | 176 | 195 | 2.5 | 1.5/1 | 0.28 |
| 28 | | $3.0 \times 10^3$ | 176 | 195 | 2.5 | 1.5/1 | 0.28 |
| 29 | | $5.0 \times 10^4$ | 176 | 195 | 2.5 | 1.5/1 | 0.28 |
| 30 | | $1.0 \times 10^5$ | 176 | 195 | 2.5 | 1.5/1 | 0.28 |
| 31 | | $5.0 \times 10^3$ | 207 | 144 | 1 | 2.4/1 | 0.34 |
| 32 | | $5.0 \times 10^3$ | 207 | 144 | 4 | 2.4/1 | 0.28 |
| 33 | | $1.0 \times 10^3$ | 228 | 109 | 1.5 | 3.5/1 | 0.36 |
| 34 | | $1.0 \times 10^5$ | 176 | 195 | 3.5 | 1.5/1 | 0.27 |

TABLE 2

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | P/B | Used for coating solution for conductive layer: Average particle diameter of metal oxide particle [μm] |
|---|---|---|---|---|---|---|---|
| 35 | Tin oxide particle coated with tin oxide doped with niobium (Average primary particle diameter: 180 nm) | $1.0 \times 10^3$ | 207 | 144 | 2.5 | 2.4/1 | 0.25 |
| 36 | | $3.0 \times 10^3$ | 207 | 144 | 2.5 | 2.4/1 | 0.25 |
| 37 | | $1.0 \times 10^4$ | 207 | 144 | 2.5 | 2.4/1 | 0.25 |
| 38 | | $5.0 \times 10^4$ | 207 | 144 | 2.5 | 2.4/1 | 0.25 |
| 39 | | $1.0 \times 10^5$ | 207 | 144 | 2.5 | 2.4/1 | 0.25 |
| 40 | | $1.0 \times 10^3$ | 228 | 109 | 2.5 | 3.5/1 | 0.27 |
| 41 | | $3.0 \times 10^3$ | 228 | 109 | 2.5 | 3.5/1 | 0.27 |
| 42 | | $5.0 \times 10^4$ | 228 | 109 | 2.5 | 3.5/1 | 0.27 |
| 43 | | $1.0 \times 10^5$ | 228 | 109 | 2.5 | 3.5/1 | 0.27 |
| 44 | | $1.0 \times 10^3$ | 176 | 195 | 2.5 | 1.5/1 | 0.23 |
| 45 | | $3.0 \times 10^3$ | 176 | 195 | 2.5 | 1.5/1 | 0.23 |
| 46 | | $5.0 \times 10^4$ | 176 | 195 | 2.5 | 1.5/1 | 0.23 |
| 47 | | $1.0 \times 10^5$ | 176 | 195 | 2.5 | 1.5/1 | 0.23 |
| 48 | | $5.0 \times 10^3$ | 207 | 144 | 1 | 2.4/1 | 0.29 |
| 49 | | $5.0 \times 10^3$ | 207 | 144 | 4 | 2.4/1 | 0.23 |
| 50 | | $1.0 \times 10^3$ | 228 | 109 | 1.5 | 3.5/1 | 0.31 |
| 51 | | $1.0 \times 10^5$ | 176 | 195 | 3.5 | 1.5/1 | 0.22 |
| 52 | Tin oxide particle coated with tin oxide doped with tantalum (Average primary particle diameter: 180 nm) | $1.0 \times 10^3$ | 207 | 144 | 2.5 | 2.4/1 | 0.26 |
| 53 | | $3.0 \times 10^3$ | 207 | 144 | 2.5 | 2.4/1 | 0.26 |
| 54 | | $1.0 \times 10^4$ | 207 | 144 | 2.5 | 2.4/1 | 0.26 |
| 55 | | $5.0 \times 10^4$ | 207 | 144 | 2.5 | 2.4/1 | 0.26 |
| 56 | | $1.0 \times 10^5$ | 207 | 144 | 2.5 | 2.4/1 | 0.26 |
| 57 | | $1.0 \times 10^3$ | 228 | 109 | 2.5 | 3.5/1 | 0.28 |
| 58 | | $3.0 \times 10^3$ | 228 | 109 | 2.5 | 3.5/1 | 0.28 |
| 59 | | $5.0 \times 10^4$ | 228 | 109 | 2.5 | 3.5/1 | 0.28 |
| 60 | | $1.0 \times 10^5$ | 228 | 109 | 2.5 | 3.5/1 | 0.28 |
| 61 | | $1.0 \times 10^3$ | 176 | 195 | 2.5 | 1.5/1 | 0.24 |
| 62 | | $3.0 \times 10^3$ | 176 | 195 | 2.5 | 1.5/1 | 0.24 |
| 63 | | $5.0 \times 10^4$ | 176 | 195 | 2.5 | 1.5/1 | 0.24 |
| 64 | | $1.0 \times 10^5$ | 176 | 195 | 2.5 | 1.5/1 | 0.24 |
| 65 | | $5.0 \times 10^3$ | 207 | 144 | 1 | 2.4/1 | 0.30 |
| 66 | | $5.0 \times 10^3$ | 207 | 144 | 4 | 2.4/1 | 0.24 |
| 67 | | $1.0 \times 10^3$ | 228 | 109 | 1.5 | 3.5/1 | 0.32 |
| 68 | | $1.0 \times 10^5$ | 176 | 195 | 3.5 | 1.5/1 | 0.23 |

TABLE 3

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | P/B | Used for coating solution for conductive layer: Average particle diameter of metal oxide particle [μm] |
|---|---|---|---|---|---|---|---|
| 69 | Zinc oxide particle coated with tin oxide doped with niobium (Average primary particle diameter: 210 nm) | $1.0 \times 10^3$ | 207 | 144 | 2.5 | 2.4/1 | 0.27 |
| 70 | | $3.0 \times 10^3$ | 207 | 144 | 2.5 | 2.4/1 | 0.27 |
| 71 | | $1.0 \times 10^4$ | 207 | 144 | 2.5 | 2.4/1 | 0.27 |
| 72 | | $5.0 \times 10^4$ | 207 | 144 | 2.5 | 2.4/1 | 0.27 |
| 73 | | $1.0 \times 10^5$ | 207 | 144 | 2.5 | 2.4/1 | 0.27 |
| 74 | | $1.0 \times 10^3$ | 228 | 109 | 2.5 | 3.5/1 | 0.29 |
| 75 | | $3.0 \times 10^3$ | 228 | 109 | 2.5 | 3.5/1 | 0.29 |
| 76 | | $5.0 \times 10^4$ | 228 | 109 | 2.5 | 3.5/1 | 0.29 |
| 77 | | $1.0 \times 10^5$ | 228 | 109 | 2.5 | 3.5/1 | 0.29 |
| 78 | | $1.0 \times 10^3$ | 176 | 195 | 2.5 | 1.5/1 | 0.25 |
| 79 | | $3.0 \times 10^3$ | 176 | 195 | 2.5 | 1.5/1 | 0.25 |
| 80 | | $5.0 \times 10^4$ | 176 | 195 | 2.5 | 1.5/1 | 0.25 |
| 81 | | $1.0 \times 10^5$ | 176 | 195 | 2.5 | 1.5/1 | 0.25 |
| 82 | | $5.0 \times 10^3$ | 207 | 144 | 1 | 2.4/1 | 0.31 |
| 83 | | $5.0 \times 10^3$ | 207 | 144 | 4 | 2.4/1 | 0.25 |
| 84 | | $1.0 \times 10^3$ | 228 | 109 | 1.5 | 3.5/1 | 0.33 |
| 85 | | $1.0 \times 10^5$ | 176 | 195 | 3.5 | 1.5/1 | 0.24 |
| 86 | Zinc oxide particle coated | $1.0 \times 10^3$ | 207 | 144 | 2.5 | 2.4/1 | 0.28 |

TABLE 3-continued

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| 87 | with tin oxide doped with | $3.0 \times 10^3$ | 207 | 144 | 2.5 | 2.4/1 | 0.28 |
| 88 | tantalum (Average primary | $1.0 \times 10^4$ | 207 | 144 | 2.5 | 2.4/1 | 0.28 |
| 89 | particle diameter: 210 nm) | $5.0 \times 10^4$ | 207 | 144 | 2.5 | 2.4/1 | 0.28 |
| 90 | | $1.0 \times 10^5$ | 207 | 144 | 2.5 | 2.4/1 | 0.28 |
| 91 | | $1.0 \times 10^3$ | 228 | 109 | 2.5 | 3.5/1 | 0.30 |
| 92 | | $3.0 \times 10^3$ | 228 | 109 | 2.5 | 3.5/1 | 0.30 |
| 93 | | $5.0 \times 10^4$ | 228 | 109 | 2.5 | 3.5/1 | 0.30 |
| 94 | | $1.0 \times 10^5$ | 228 | 109 | 2.5 | 3.5/1 | 0.30 |
| 95 | | $1.0 \times 10^3$ | 176 | 195 | 2.5 | 1.5/1 | 0.26 |
| 96 | | $3.0 \times 10^3$ | 176 | 195 | 2.5 | 1.5/1 | 0.26 |
| 97 | | $5.0 \times 10^4$ | 176 | 195 | 2.5 | 1.5/1 | 0.26 |
| 98 | | $1.0 \times 10^5$ | 176 | 195 | 2.5 | 1.5/1 | 0.26 |
| 99 | | $5.0 \times 10^3$ | 207 | 144 | 1 | 2.4/1 | 0.32 |
| 100 | | $5.0 \times 10^3$ | 207 | 144 | 4 | 2.4/1 | 0.26 |
| 101 | | $1.0 \times 10^3$ | 228 | 109 | 1.5 | 3.5/1 | 0.34 |
| 102 | | $1.0 \times 10^5$ | 176 | 195 | 3.5 | 1.5/1 | 0.25 |

TABLE 4

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| 103 | Zirconium oxide particle coated | $1.0 \times 10^3$ | 228 | 109 | 2.5 | 3.5/1 | 0.30 |
| 104 | with tin oxide doped with | $1.0 \times 10^5$ | 228 | 109 | 2.5 | 3.5/1 | 0.30 |
| 105 | niobium (Average primary | $1.0 \times 10^3$ | 176 | 195 | 2.5 | 1.5/1 | 0.26 |
| 106 | particle diameter: 210 nm) | $1.0 \times 10^5$ | 176 | 195 | 2.5 | 1.5/1 | 0.26 |
| 107 | Zirconium oxide particle coated | $1.0 \times 10^3$ | 228 | 109 | 2.5 | 3.5/1 | 0.31 |
| 108 | with tin oxide doped with | $1.0 \times 10^5$ | 228 | 109 | 2.5 | 3.5/1 | 0.31 |
| 109 | tantalum (Average primary | $1.0 \times 10^3$ | 176 | 195 | 2.5 | 1.5/1 | 0.27 |
| 110 | particle diameter: 210 nm) | $1.0 \times 10^5$ | 176 | 195 | 2.5 | 1.5/1 | 0.27 |

TABLE 5

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| C1 | Titanium oxide particle coated | $5.0 \times 10^2$ | 207 | 144 | 2.5 | 2.4/1 | 0.29 |
| C2 | with tin oxide doped with | $5.0 \times 10^5$ | 207 | 144 | 2.5 | 2.4/1 | 0.29 |
| C3 | niobium (Average primary | $5.0 \times 10^2$ | 228 | 109 | 2.5 | 3.5/1 | 0.31 |
| C4 | particle diameter: 250 nm) | $5.0 \times 10^2$ | 176 | 195 | 2.5 | 1.5/1 | 0.27 |
| C5 | | $5.0 \times 10^5$ | 228 | 109 | 2.5 | 3.5/1 | 0.31 |
| C6 | | $5.0 \times 10^5$ | 176 | 195 | 2.5 | 1.5/1 | 0.27 |
| C7 | | $1.0 \times 10^3$ | 171 | 203 | 2.5 | 1.4/1 | 0.25 |
| C8 | | $1.0 \times 10^3$ | 285 | 132 | 2.5 | 3.6/1 | 0.36 |
| C9 | | $1.0 \times 10^5$ | 171 | 203 | 2.5 | 1.4/1 | 0.25 |
| C10 | | $1.0 \times 10^5$ | 285 | 132 | 2.5 | 3.6/1 | 0.36 |
| C11 | | $1.0 \times 10^3$ | 228 | 109 | 0.75 | 3.5/1 | 0.41 |
| C12 | | $1.0 \times 10^5$ | 176 | 195 | 5 | 1.5/1 | 0.25 |
| C13 | Titanium oxide particle coated | $5.0 \times 10^2$ | 207 | 144 | 2.5 | 2.4/1 | 0.30 |
| C14 | with tin oxide doped with | $5.0 \times 10^5$ | 207 | 144 | 2.5 | 2.4/1 | 0.30 |

TABLE 5-continued

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | P/B | Used for coating solution for conductive layer Average particle diameter of metal oxide particle [μm] |
|---|---|---|---|---|---|---|---|
| C15 | tantalum (Average primary | $5.0 \times 10^2$ | 228 | 109 | 2.5 | 3.5/1 | 0.32 |
| C16 | particle diameter: 250 nm) | $5.0 \times 10^2$ | 176 | 195 | 2.5 | 1.5/1 | 0.28 |
| C17 | | $5.0 \times 10^5$ | 228 | 109 | 2.5 | 3.5/1 | 0.32 |
| C18 | | $5.0 \times 10^5$ | 176 | 195 | 2.5 | 1.5/1 | 0.28 |
| C19 | | $1.0 \times 10^3$ | 171 | 203 | 2.5 | 1.4/1 | 0.26 |
| C20 | | $1.0 \times 10^3$ | 285 | 132 | 2.5 | 3.6/1 | 0.37 |
| C21 | | $1.0 \times 10^5$ | 171 | 203 | 2.5 | 1.4/1 | 0.26 |
| C22 | | $1.0 \times 10^5$ | 285 | 132 | 2.5 | 3.6/1 | 0.37 |
| C23 | | $1.0 \times 10^3$ | 228 | 109 | 0.75 | 3.5/1 | 0.42 |
| C24 | | $1.0 \times 10^5$ | 176 | 195 | 5 | 1.5/1 | 0.26 |

TABLE 6

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | P/B | Used for coating solution for conductive layer Average particle diameter of metal oxide particle [μm] |
|---|---|---|---|---|---|---|---|
| C25 | Tin oxide particle coated | $5.0 \times 10^2$ | 207 | 144 | 2.5 | 2.4/1 | 0.25 |
| C26 | with tin oxide doped with | $5.0 \times 10^5$ | 207 | 144 | 2.5 | 2.4/1 | 0.25 |
| C27 | niobium (Average primary | $5.0 \times 10^2$ | 228 | 109 | 2.5 | 3.5/1 | 0.27 |
| C28 | particle diameter: 180 nm) | $5.0 \times 10^2$ | 176 | 195 | 2.5 | 1.5/1 | 0.23 |
| C29 | | $5.0 \times 10^5$ | 228 | 109 | 2.5 | 3.5/1 | 0.27 |
| C30 | | $5.0 \times 10^5$ | 176 | 195 | 2.5 | 1.5/1 | 0.23 |
| C31 | | $1.0 \times 10^3$ | 171 | 203 | 2.5 | 1.4/1 | 0.21 |
| C32 | | $1.0 \times 10^3$ | 285 | 132 | 2.5 | 3.6/1 | 0.32 |
| C33 | | $1.0 \times 10^5$ | 171 | 203 | 2.5 | 1.4/1 | 0.21 |
| C34 | | $1.0 \times 10^5$ | 285 | 132 | 2.5 | 3.6/1 | 0.32 |
| C35 | | $1.0 \times 10^3$ | 228 | 109 | 0.75 | 3.5/1 | 0.37 |
| C36 | | $1.0 \times 10^5$ | 176 | 195 | 5 | 1.5/1 | 0.21 |
| C37 | Tin oxide particle coated | $5.0 \times 10^2$ | 207 | 144 | 2.5 | 2.4/1 | 0.26 |
| C38 | with tin oxide doped with | $5.0 \times 10^5$ | 207 | 144 | 2.5 | 2.4/1 | 0.26 |
| C39 | tantalum (Average primary | $5.0 \times 10^2$ | 228 | 109 | 2.5 | 3.5/1 | 0.28 |
| C40 | particle diameter: 180 nm) | $5.0 \times 10^2$ | 176 | 195 | 2.5 | 1.5/1 | 0.24 |
| C41 | | $5.0 \times 10^5$ | 228 | 109 | 2.5 | 3.5/1 | 0.28 |
| C42 | | $5.0 \times 10^5$ | 176 | 195 | 2.5 | 1.5/1 | 0.24 |
| C43 | | $1.0 \times 10^3$ | 171 | 203 | 2.5 | 1.4/1 | 0.22 |
| C44 | | $1.0 \times 10^3$ | 285 | 132 | 2.5 | 3.6/1 | 0.33 |
| C45 | | $1.0 \times 10^5$ | 171 | 203 | 2.5 | 1.4/1 | 0.22 |
| C46 | | $1.0 \times 10^5$ | 285 | 132 | 2.5 | 3.6/1 | 0.33 |
| C47 | | $1.0 \times 10^3$ | 228 | 109 | 0.75 | 3.5/1 | 0.38 |
| C48 | | $1.0 \times 10^5$ | 176 | 195 | 5 | 1.5/1 | 0.22 |

TABLE 7

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | P/B | Used for coating solution for conductive layer Average particle diameter of metal oxide particle [μm] |
|---|---|---|---|---|---|---|---|
| C49 | Zinc oxide particle coated | $5.0 \times 10^2$ | 207 | 144 | 2.5 | 2.4/1 | 0.27 |
| C50 | with tin oxide doped with | $5.0 \times 10^5$ | 207 | 144 | 2.5 | 2.4/1 | 0.27 |
| C51 | niobium (Average primary | $5.0 \times 10^2$ | 228 | 109 | 2.5 | 3.5/1 | 0.29 |
| C52 | particle diameter: 210 nm) | $5.0 \times 10^2$ | 176 | 195 | 2.5 | 1.5/1 | 0.25 |

TABLE 7-continued

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| C53 | | $5.0 \times 10^5$ | 228 | 109 | 2.5 | 3.5/1 | 0.29 |
| C54 | | $5.0 \times 10^5$ | 176 | 195 | 2.5 | 1.5/1 | 0.25 |
| C55 | | $1.0 \times 10^3$ | 171 | 203 | 2.5 | 1.4/1 | 0.23 |
| C56 | | $1.0 \times 10^3$ | 285 | 132 | 2.5 | 3.6/1 | 0.34 |
| C57 | | $1.0 \times 10^5$ | 171 | 203 | 2.5 | 1.4/1 | 0.23 |
| C58 | | $1.0 \times 10^5$ | 285 | 132 | 2.5 | 3.6/1 | 0.34 |
| C59 | | $1.0 \times 10^3$ | 228 | 109 | 0.75 | 3.5/1 | 0.39 |
| C60 | | $1.0 \times 10^5$ | 176 | 195 | 5 | 1.5/1 | 0.23 |
| C61 | Zinc oxide particle coated | $5.0 \times 10^2$ | 207 | 144 | 2.5 | 2.4/1 | 0.28 |
| C62 | with tin oxide doped with | $5.0 \times 10^5$ | 207 | 144 | 2.5 | 2.4/1 | 0.28 |
| C63 | tantalum (Average primary | $5.0 \times 10^2$ | 228 | 109 | 2.5 | 3.5/1 | 0.30 |
| C64 | particle diameter: 210 nm) | $5.0 \times 10^2$ | 176 | 195 | 2.5 | 1.5/1 | 0.26 |
| C65 | | $5.0 \times 10^5$ | 228 | 109 | 2.5 | 3.5/1 | 0.30 |
| C66 | | $5.0 \times 10^5$ | 176 | 195 | 2.5 | 1.5/1 | 0.26 |
| C67 | | $1.0 \times 10^3$ | 171 | 203 | 2.5 | 1.4/1 | 0.24 |
| C68 | | $1.0 \times 10^3$ | 285 | 132 | 2.5 | 3.6/1 | 0.35 |
| C69 | | $1.0 \times 10^5$ | 171 | 203 | 2.5 | 1.4/1 | 0.24 |
| C70 | | $1.0 \times 10^5$ | 285 | 132 | 2.5 | 3.6/1 | 0.35 |
| C71 | | $1.0 \times 10^3$ | 228 | 109 | 0.75 | 3.5/1 | 0.40 |
| C72 | | $1.0 \times 10^5$ | 176 | 195 | 5 | 1.5/1 | 0.24 |

TABLE 8

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| C73 | Zirconium oxide particle coated | $5.0 \times 10^2$ | 228 | 109 | 2.5 | 3.5/1 | 0.30 |
| C74 | with tin oxide doped with | $5.0 \times 10^2$ | 176 | 195 | 2.5 | 1.5/1 | 0.30 |
| C75 | niobium (Average primary | $5.0 \times 10^5$ | 228 | 109 | 2.5 | 3.5/1 | 0.26 |
| C76 | particle diameter: 210 nm) | $5.0 \times 10^5$ | 176 | 195 | 2.5 | 1.5/1 | 0.26 |
| C77 | Zirconium oxide particle coated | $5.0 \times 10^2$ | 228 | 109 | 2.5 | 3.5/1 | 0.31 |
| C78 | with tin oxide doped with | $5.0 \times 10^2$ | 176 | 195 | 2.5 | 1.5/1 | 0.31 |
| C79 | tantalum (Average primary | $5.0 \times 10^5$ | 228 | 109 | 2.5 | 3.5/1 | 0.27 |
| C80 | particle diameter: 210 nm) | $5.0 \times 10^5$ | 176 | 195 | 2.5 | 1.5/1 | 0.27 |
| C81 | Tin oxide particle doped | $1.0 \times 10^3$ | 228 | 109 | 2.5 | 3.5/1 | 0.47 |
| C82 | with niobium (Average primary | $1.0 \times 10^5$ | 228 | 109 | 2.5 | 3.5/1 | 0.47 |
| C83 | particle diameter: 150 nm) | $1.0 \times 10^3$ | 176 | 195 | 2.5 | 1.5/1 | 0.49 |
| C84 | | $1.0 \times 10^5$ | 176 | 195 | 2.5 | 1.5/1 | 0.49 |
| C85 | Tin oxide particle doped | $1.0 \times 10^3$ | 228 | 109 | 2.5 | 3.5/1 | 0.48 |
| C86 | with tantalum (Average primary | $1.0 \times 10^5$ | 228 | 109 | 2.5 | 3.5/1 | 0.48 |
| C87 | particle diameter: 150 nm) | $1.0 \times 10^3$ | 176 | 195 | 2.5 | 1.5/1 | 0.50 |
| C88 | | $1.0 \times 10^5$ | 176 | 195 | 2.5 | 1.5/1 | 0.50 |

TABLE 9

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | Used for coating solution for conductive layer P/B | Average particle diameter of metal oxide particle [μm] |
|---|---|---|---|---|---|---|---|
| C89 | Barium sulfate particle coated | $1.0 \times 10^3$ | 228 | 109 | 2.5 | 3.5/1 | 0.26 |
| C90 | with tin oxide doped with | $1.0 \times 10^5$ | 228 | 109 | 2.5 | 3.5/1 | 0.26 |

TABLE 9-continued

| Coating solution for conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion treatment time [h] | P/B | Used for coating solution for conductive layer Average particle diameter of metal oxide particle [μm] |
|---|---|---|---|---|---|---|---|
| C91 | niobium (Average primary | $1.0 \times 10^3$ | 176 | 195 | 2.5 | 1.5/1 | 0.27 |
| C92 | particle diameter: 200 nm) | $1.0 \times 10^5$ | 176 | 195 | 2.5 | 1.5/1 | 0.27 |
| C93 | Barium sulfate particle coated | $1.0 \times 10^3$ | 228 | 109 | 2.5 | 3.5/1 | 0.27 |
| C94 | with tin oxide doped with | $1.0 \times 10^5$ | 228 | 109 | 2.5 | 3.5/1 | 0.27 |
| C95 | tantalum (Average primary | $1.0 \times 10^3$ | 176 | 195 | 2.5 | 1.5/1 | 0.28 |
| C96 | particle diameter: 200 nm) | $1.0 \times 10^5$ | 176 | 195 | 2.5 | 1.5/1 | 0.28 |
| C97 | Titanium oxide particle coated with tin oxide doped with antimony (Average primary particle diameter: 250 nm) | $1.0 \times 10^3$ | 176 | 195 | 2.5 | 1.5/1 | 0.25 |
| C98 | Titanium oxide particle coated with oxygen-defective tin oxide (Average primary particle diameter: 250 nm) | $1.0 \times 10^3$ | 176 | 195 | 2.5 | 1.5/1 | 0.27 |
| C99 | Uncoated titanium oxide particle (Average primary particle diameter 240 nm) | $1.0 \times 10^5$ | 228 | 109 | 2.5 | 3.5/1 | 0.37 |
| C100 | Uncoated tin oxide particle (Average primary particle diameter: 170 nm) | $1.0 \times 10^5$ | 228 | 109 | 2.5 | 3.5/1 | 0.25 |
| C101 | Uncoated zinc oxide particle (Average primary particle diameter: 200 nm) | $1.0 \times 10^5$ | 228 | 109 | 2.5 | 3.5/1 | 0.35 |

<Production Examples of Electrophotographic Photosensitive Member (Production Example of Electrophotographic Photosensitive Member 1)

A support was an aluminum cylinder having a length of 246 mm and a diameter of 24 mm and produced by a production method including extrusion and drawing (JIS-A3003, aluminum alloy).

Under an environment of normal temperature and normal humidity (23° C./50% RH), the coating liquid for a conductive layer 1 was applied onto the support by dip coating, and dried and thermally cured for 30 minutes at 140° C. to form a conductive layer having a film thickness of 30 μm. The volume resistivity of the conductive layer was measured by the method described above, and it was $5.0 \times 10^9$ Ω·cm. The largest current amount Ia and current amount Ib of the conductive layer were measured by the method described above. The largest current amount Ia was 5200 μA, and the current amount Ib was 30 μA.

Next, 4.5 parts of N-methoxymethylated nylon (trade name: TORESIN EF-30T, made by Nagase ChemteX Corporation (now-defunct Teikoku Chemical Industry, Co., Ltd.)) and 1.5 parts of a copolymerized nylon resin (trade name: AMILAN CM8000, made by Toray Industries, Inc.) were dissolved in a mixed solvent of 65 parts of methanol/30 parts of n-butanol to prepare a coating solution for an undercoat layer. The coating solution for an undercoat layer was applied onto the conductive layer by dip coating, and dried for 6 minutes at 70° C. to form an undercoat layer having a film thickness of 0.85 μm.

Next, 10 parts of crystalline hydroxy gallium phthalocyanine crystals (charge-generating substance) having strong peaks at Bragg angles (2θ±0.2° of 7.5°, 9.9°, 16.3°, 18.6°, 25.1°, and 28.3° in CuKα properties X ray diffraction, 5 parts of polyvinyl butyral (trade name: S-LECBX-1, made by Sekisui Chemical Co., Ltd.), and 250 parts of cyclohexanone were placed in a sand mill using glass beads having a diameter of 0.8 mm. The solution was dispersed under a condition: dispersing time, 3 hours. Next, 250 parts of ethyl acetate was added to the solution to prepare a coating solution for a charge-generating layer. The coating solution for a charge-generating layer was applied onto the undercoat layer by dip coating, and dried for 10 minutes at 100° C. to form a charge-generating layer having a film thickness of 0.12 μm.

Next, 4.8 parts of an amine compound (charge transport substance) represented by the following formula (CT-1):

(CT-1)

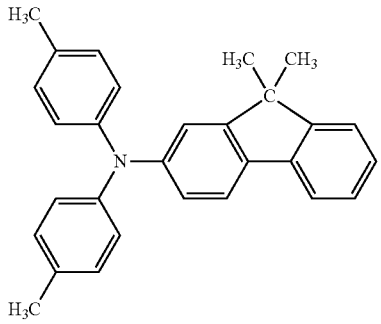

3.2 parts of an amine compound (charge transport substance) represented by the following formula (CT-2):

(CT-2)

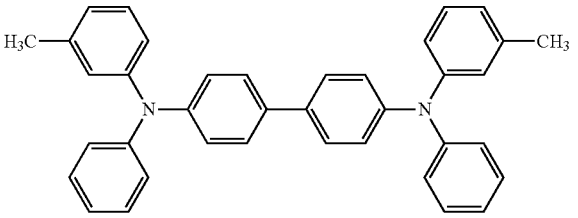

and 10 parts of polycarbonate (trade name: 2200, made by Mitsubishi Engineering-Plastics Corporation) were dissolved in a mixed solvent of 30 parts of dimethoxymethane/70 parts of chlorobenzene to prepare a coating solution for a charge transport layer. The coating solution for a charge transport layer was applied onto the charge-generating layer by dip coating, and dried for 30 minutes at 110° C. to form a charge transport layer having a film thickness of 7.5 μm.

Thus, an electrophotographic photosensitive member 1 in which the charge transport layer was the surface layer was produced.

(Production Examples of Electrophotographic Photosensitive Members 2 to 110 and C1 to C101)

Electrophotographic photosensitive members 2 to 110 and C1 to C101 in which the charge transport layer was the surface layer were produced by the same operation as that in Production Example of the electrophotographic photosensitive member 1 except that the coating liquid for a conductive layer used in production of the electrophotographic photosensitive member was changed from the coating liquid for a conductive layer 1 to the coating liquids for a conductive layer 2 to 110 and C1 to C101, respectively. In the electrophotographic photosensitive members 2 to 110 and C1 to C101, the volume resistivity of the conductive layer, the largest current amount Ia, and the current amount Ib were measured by the method described above in the same manner as that in the case of the conductive layer in the electrophotographic photosensitive member 1. The results are shown in Tables 10 to 15. In the electrophotographic photosensitive members 1 to 110 and C1 to C101, the surface of the conductive layer was observed with an optical microscope during measurement of the volume resistivity of the conductive layer. The cracked surface of the conductive layer was found in the electrophotographic photosensitive members C8, C10, C20, C22, C32, C34, C44, C46, C56, C58, C68, and C70.

TABLE 10

| Electro-photographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| 1 | 1 | $5.0 \times 10^{9}$ | Not found | 5200 | 30 |
| 2 | 2 | $1.0 \times 10^{10}$ | Not found | 3900 | 23 |
| 3 | 3 | $5.0 \times 10^{10}$ | Not found | 3500 | 21 |
| 4 | 4 | $1.0 \times 10^{11}$ | Not found | 3100 | 20 |
| 5 | 5 | $5.0 \times 10^{11}$ | Not found | 2700 | 15 |
| 6 | 6 | $1.0 \times 10^{9}$ | Not found | 5600 | 33 |
| 7 | 7 | $5.0 \times 10^{9}$ | Not found | 4200 | 26 |
| 8 | 8 | $5.0 \times 10^{10}$ | Not found | 3500 | 21 |
| 9 | 9 | $1.0 \times 10^{11}$ | Not found | 3000 | 17 |
| 10 | 10 | $1.0 \times 10^{10}$ | Not found | 5100 | 31 |
| 11 | 11 | $5.0 \times 10^{10}$ | Not found | 3500 | 21 |
| 12 | 12 | $5.0 \times 10^{11}$ | Not found | 2700 | 20 |
| 13 | 13 | $1.0 \times 10^{12}$ | Not found | 2300 | 11 |
| 14 | 14 | $1.0 \times 10^{9}$ | Not found | 4700 | 28 |
| 15 | 15 | $1.0 \times 10^{11}$ | Not found | 3100 | 20 |
| 16 | 16 | $1.0 \times 10^{8}$ | Not found | 6000 | 35 |
| 17 | 17 | $5.0 \times 10^{12}$ | Not found | 1900 | 10 |
| 18 | 18 | $5.0 \times 10^{9}$ | Not found | 5200 | 30 |
| 19 | 19 | $1.0 \times 10^{10}$ | Not found | 3900 | 23 |
| 20 | 20 | $5.0 \times 10^{10}$ | Not found | 3500 | 21 |
| 21 | 21 | $1.0 \times 10^{11}$ | Not found | 3100 | 20 |
| 22 | 22 | $5.0 \times 10^{11}$ | Not found | 2700 | 15 |
| 23 | 23 | $1.0 \times 10^{9}$ | Not found | 5600 | 33 |
| 24 | 24 | $5.0 \times 10^{9}$ | Not found | 4200 | 26 |
| 25 | 25 | $5.0 \times 10^{10}$ | Not found | 3500 | 21 |
| 26 | 26 | $1.0 \times 10^{11}$ | Not found | 3000 | 17 |

TABLE 10-continued

| Electro-photographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| 27 | 27 | $1.0 \times 10^{10}$ | Not found | 5100 | 31 |
| 28 | 28 | $5.0 \times 10^{10}$ | Not found | 3500 | 21 |
| 29 | 29 | $5.0 \times 10^{11}$ | Not found | 2700 | 20 |
| 30 | 30 | $1.0 \times 10^{12}$ | Not found | 2300 | 11 |
| 31 | 31 | $1.0 \times 10^{9}$ | Not found | 4700 | 28 |
| 32 | 32 | $1.0 \times 10^{11}$ | Not found | 3100 | 20 |
| 33 | 33 | $1.0 \times 10^{8}$ | Not found | 6000 | 35 |
| 34 | 34 | $5.0 \times 10^{12}$ | Not found | 1900 | 10 |
| 35 | 35 | $5.0 \times 10^{9}$ | Not found | 5600 | 36 |
| 36 | 36 | $1.0 \times 10^{10}$ | Not found | 4200 | 26 |
| 37 | 37 | $5.0 \times 10^{10}$ | Not found | 3700 | 24 |
| 38 | 38 | $1.0 \times 10^{11}$ | Not found | 3300 | 22 |
| 39 | 39 | $5.0 \times 10^{11}$ | Not found | 3000 | 16 |
| 40 | 40 | $1.0 \times 10^{9}$ | Not found | 5900 | 38 |

TABLE 11

| Electrop-hotographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| 41 | 41 | $5.0 \times 10^{9}$ | Not found | 4500 | 30 |
| 42 | 42 | $5.0 \times 10^{10}$ | Not found | 3700 | 24 |
| 43 | 43 | $1.0 \times 10^{11}$ | Not found | 3300 | 19 |
| 44 | 44 | $1.0 \times 10^{10}$ | Not found | 5300 | 34 |
| 45 | 45 | $5.0 \times 10^{10}$ | Not found | 3700 | 24 |
| 46 | 46 | $5.0 \times 10^{11}$ | Not found | 3000 | 22 |
| 47 | 47 | $1.0 \times 10^{12}$ | Not found | 2600 | 15 |
| 48 | 48 | $1.0 \times 10^{9}$ | Not found | 4900 | 33 |
| 49 | 49 | $1.0 \times 10^{11}$ | Not found | 3200 | 22 |
| 50 | 50 | $1.0 \times 10^{8}$ | Not found | 6000 | 42 |
| 51 | 51 | $5.0 \times 10^{12}$ | Not found | 2200 | 10 |
| 52 | 52 | $5.0 \times 10^{9}$ | Not found | 5600 | 36 |
| 53 | 53 | $1.0 \times 10^{10}$ | Not found | 4200 | 26 |
| 54 | 54 | $5.0 \times 10^{10}$ | Not found | 3700 | 24 |
| 55 | 55 | $1.0 \times 10^{11}$ | Not found | 3300 | 22 |
| 56 | 56 | $5.0 \times 10^{11}$ | Not found | 3000 | 16 |
| 57 | 57 | $1.0 \times 10^{9}$ | Not found | 5900 | 38 |
| 58 | 58 | $5.0 \times 10^{9}$ | Not found | 4500 | 30 |
| 59 | 59 | $5.0 \times 10^{10}$ | Not found | 3700 | 24 |
| 60 | 60 | $1.0 \times 10^{11}$ | Not found | 3300 | 19 |
| 61 | 61 | $1.0 \times 10^{10}$ | Not found | 5300 | 34 |
| 62 | 62 | $5.0 \times 10^{10}$ | Not found | 3700 | 24 |
| 63 | 63 | $5.0 \times 10^{11}$ | Not found | 3000 | 22 |
| 64 | 64 | $1.0 \times 10^{12}$ | Not found | 2600 | 15 |
| 65 | 65 | $1.0 \times 10^{9}$ | Not found | 4900 | 33 |
| 66 | 66 | $1.0 \times 10^{11}$ | Not found | 3200 | 22 |
| 67 | 67 | $1.0 \times 10^{8}$ | Not found | 6000 | 42 |
| 68 | 68 | $5.0 \times 10^{12}$ | Not found | 2200 | 10 |
| 69 | 69 | $5.0 \times 10^{9}$ | Not found | 5100 | 28 |
| 70 | 70 | $1.0 \times 10^{10}$ | Not found | 3800 | 22 |
| 71 | 71 | $5.0 \times 10^{10}$ | Not found | 3400 | 21 |
| 72 | 72 | $1.0 \times 10^{11}$ | Not found | 3000 | 20 |
| 73 | 73 | $5.0 \times 10^{11}$ | Not found | 2600 | 13 |
| 74 | 74 | $1.0 \times 10^{9}$ | Not found | 5400 | 31 |
| 75 | 75 | $5.0 \times 10^{9}$ | Not found | 4000 | 24 |
| 76 | 76 | $5.0 \times 10^{10}$ | Not found | 3300 | 20 |
| 77 | 77 | $1.0 \times 10^{11}$ | Not found | 2800 | 15 |
| 78 | 78 | $1.0 \times 10^{10}$ | Not found | 5100 | 28 |
| 79 | 79 | $5.0 \times 10^{10}$ | Not found | 3400 | 21 |
| 80 | 80 | $5.0 \times 10^{11}$ | Not found | 2500 | 20 |

TABLE 12

| Electro-photographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| 81 | 81 | $1.0 \times 10^{12}$ | Not found | 2200 | 10 |
| 82 | 82 | $1.0 \times 10^{9}$ | Not found | 4500 | 28 |
| 83 | 83 | $1.0 \times 10^{11}$ | Not found | 3000 | 20 |
| 84 | 84 | $1.0 \times 10^{8}$ | Not found | 6000 | 34 |
| 85 | 85 | $5.0 \times 10^{12}$ | Not found | 1800 | 10 |
| 86 | 86 | $5.0 \times 10^{9}$ | Not found | 5100 | 28 |
| 87 | 87 | $1.0 \times 10^{10}$ | Not found | 3800 | 22 |
| 88 | 88 | $5.0 \times 10^{10}$ | Not found | 3400 | 21 |
| 89 | 89 | $1.0 \times 10^{11}$ | Not found | 3000 | 20 |
| 90 | 90 | $5.0 \times 10^{11}$ | Not found | 2600 | 13 |
| 91 | 91 | $1.0 \times 10^{9}$ | Not found | 5400 | 31 |
| 92 | 92 | $5.0 \times 10^{9}$ | Not found | 4000 | 24 |
| 93 | 93 | $5.0 \times 10^{10}$ | Not found | 3300 | 20 |
| 94 | 94 | $1.0 \times 10^{11}$ | Not found | 2800 | 15 |
| 95 | 95 | $1.0 \times 10^{10}$ | Not found | 5100 | 28 |
| 96 | 96 | $5.0 \times 10^{10}$ | Not found | 3400 | 21 |
| 97 | 97 | $5.0 \times 10^{11}$ | Not found | 2500 | 20 |
| 98 | 98 | $1.0 \times 10^{12}$ | Not found | 2200 | 10 |
| 99 | 99 | $1.0 \times 10^{9}$ | Not found | 4500 | 28 |
| 100 | 100 | $1.0 \times 10^{11}$ | Not found | 3000 | 20 |
| 101 | 101 | $1.0 \times 10^{8}$ | Not found | 6000 | 34 |
| 102 | 102 | $5.0 \times 10^{12}$ | Not found | 1800 | 10 |
| 103 | 103 | $1.0 \times 10^{9}$ | Not found | 5300 | 29 |
| 104 | 104 | $1.0 \times 10^{11}$ | Not found | 2600 | 14 |
| 105 | 105 | $1.0 \times 10^{10}$ | Not found | 5100 | 24 |
| 106 | 106 | $1.0 \times 10^{12}$ | Not found | 2100 | 10 |
| 107 | 107 | $1.0 \times 10^{9}$ | Not found | 5300 | 29 |
| 108 | 108 | $1.0 \times 10^{11}$ | Not found | 2600 | 14 |
| 109 | 109 | $1.0 \times 10^{10}$ | Not found | 5100 | 24 |
| 110 | 110 | $1.0 \times 10^{12}$ | Not found | 2100 | 10 |

TABLE 13

| Electro-photographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| C1 | C1 | $1.0 \times 10^{9}$ | Not found | 6600 | 40 |
| C2 | C2 | $1.0 \times 10^{12}$ | Not found | 2200 | 5 |
| C3 | C3 | $5.0 \times 10^{8}$ | Not found | 7200 | 42 |
| C4 | C4 | $5.0 \times 10^{9}$ | Not found | 6200 | 40 |
| C5 | C5 | $5.0 \times 10^{11}$ | Not found | 2600 | 6 |
| C6 | C6 | $5.0 \times 10^{12}$ | Not found | 1800 | 4 |
| C7 | C7 | $5.0 \times 10^{9}$ | Not found | 6200 | 40 |
| C8 | C8 | $5.0 \times 10^{8}$ | Found | 7200 | 42 |
| C9 | C9 | $5.0 \times 10^{12}$ | Not found | 1800 | 4 |
| C10 | C10 | $5.0 \times 10^{10}$ | Found | 3400 | 8 |
| C11 | C11 | $5.0 \times 10^{7}$ | Not found | 6100 | 38 |
| C12 | C12 | $1.0 \times 10^{13}$ | Not found | 1600 | 4 |
| C13 | C13 | $1.0 \times 10^{9}$ | Not found | 6600 | 40 |
| C14 | C14 | $1.0 \times 10^{12}$ | Not found | 2200 | 5 |
| C15 | C15 | $5.0 \times 10^{8}$ | Not found | 7200 | 42 |
| C16 | C16 | $5.0 \times 10^{9}$ | Not found | 6200 | 40 |
| C17 | C17 | $5.0 \times 10^{11}$ | Not found | 2600 | 6 |
| C18 | C18 | $5.0 \times 10^{12}$ | Not found | 1800 | 4 |
| C19 | C19 | $5.0 \times 10^{9}$ | Not found | 6200 | 40 |
| C20 | C20 | $5.0 \times 10^{8}$ | Found | 7200 | 42 |
| C21 | C21 | $5.0 \times 10^{12}$ | Not found | 1800 | 4 |
| C22 | C22 | $5.0 \times 10^{10}$ | Found | 3400 | 8 |
| C23 | C23 | $5.0 \times 10^{7}$ | Not found | 6100 | 38 |
| C24 | C24 | $1.0 \times 10^{13}$ | Not found | 1600 | 4 |
| C25 | C25 | $1.0 \times 10^{9}$ | Not found | 7000 | 44 |
| C26 | C26 | $1.0 \times 10^{12}$ | Not found | 2600 | 7 |
| C27 | C27 | $5.0 \times 10^{8}$ | Not found | 7600 | 46 |
| C28 | C28 | $5.0 \times 10^{9}$ | Not found | 6600 | 44 |

TABLE 13-continued

| Electro-photographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| C29 | C29 | $5.0 \times 10^{11}$ | Not found | 3000 | 8 |
| C30 | C30 | $5.0 \times 10^{12}$ | Not found | 2200 | 6 |
| C31 | C31 | $5.0 \times 10^{9}$ | Not found | 6600 | 44 |
| C32 | C32 | $5.0 \times 10^{8}$ | Found | 7600 | 46 |
| C33 | C33 | $5.0 \times 10^{12}$ | Not found | 2200 | 6 |
| C34 | C34 | $5.0 \times 10^{10}$ | Found | 3800 | 9 |
| C35 | C35 | $5.0 \times 10^{7}$ | Not found | 6500 | 42 |
| C36 | C36 | $1.0 \times 10^{13}$ | Not found | 2000 | 6 |
| C37 | C37 | $1.0 \times 10^{9}$ | Not found | 7000 | 44 |
| C38 | C38 | $1.0 \times 10^{12}$ | Not found | 2600 | 7 |
| C39 | C39 | $5.0 \times 10^{8}$ | Not found | 7600 | 46 |
| C40 | C40 | $5.0 \times 10^{9}$ | Not found | 6600 | 44 |

TABLE 14

| Electro-photographic photosensitive member | Coating solution for conductive layer | Volume resistivity of conductive layer [Ω · cm] | Crack of conductive layer | Current amount la[μA] | Current amount lb[μA] |
|---|---|---|---|---|---|
| C41 | C41 | $5.0 \times 10^{11}$ | Not found | 3000 | 8 |
| C42 | C42 | $5.0 \times 10^{12}$ | Not found | 2200 | 6 |
| C43 | C43 | $5.0 \times 10^{9}$ | Not found | 6600 | 44 |
| C44 | C44 | $5.0 \times 10^{8}$ | Found | 7600 | 46 |
| C45 | C45 | $5.0 \times 10^{12}$ | Not found | 2200 | 6 |
| C46 | C46 | $5.0 \times 10^{10}$ | Found | 3800 | 9 |
| C47 | C47 | $5.0 \times 10^{7}$ | Not found | 6500 | 42 |
| C48 | C48 | $1.0 \times 10^{13}$ | Not found | 2000 | 6 |
| C49 | C49 | $1.0 \times 10^{9}$ | Not found | 6500 | 36 |
| C50 | C50 | $1.0 \times 10^{12}$ | Not found | 2100 | 4 |
| C51 | C51 | $5.0 \times 10^{8}$ | Not found | 7100 | 38 |
| C52 | C52 | $5.0 \times 10^{9}$ | Not found | 6100 | 36 |
| C53 | C53 | $5.0 \times 10^{11}$ | Not found | 2500 | 6 |
| C54 | C54 | $5.0 \times 10^{12}$ | Not found | 1800 | 4 |
| C55 | C55 | $5.0 \times 10^{9}$ | Not found | 6100 | 36 |
| C56 | C56 | $5.0 \times 10^{8}$ | Found | 7100 | 38 |
| C57 | C57 | $5.0 \times 10^{12}$ | Not found | 1700 | 4 |
| C58 | C58 | $5.0 \times 10^{10}$ | Found | 3300 | 7 |
| C59 | C59 | $5.0 \times 10^{7}$ | Not found | 6100 | 35 |
| C60 | C60 | $1.0 \times 10^{13}$ | Not found | 1500 | 4 |
| C61 | C61 | $1.0 \times 10^{9}$ | Not found | 6500 | 36 |
| C62 | C62 | $1.0 \times 10^{12}$ | Not found | 2100 | 4 |
| C63 | C63 | $5.0 \times 10^{8}$ | Not found | 7100 | 38 |
| C64 | C64 | $5.0 \times 10^{9}$ | Not found | 6100 | 36 |
| C65 | C65 | $5.0 \times 10^{11}$ | Not found | 2500 | 6 |
| C66 | C66 | $5.0 \times 10^{12}$ | Not found | 1800 | 4 |
| C67 | C67 | $5.0 \times 10^{9}$ | Not found | 6100 | 36 |
| C68 | C68 | $5.0 \times 10^{8}$ | Found | 7100 | 38 |
| C69 | C69 | $5.0 \times 10^{12}$ | Not found | 1700 | 4 |
| C70 | C70 | $5.0 \times 10^{10}$ | Found | 3300 | 7 |
| C71 | C71 | $5.0 \times 10^{7}$ | Not found | 6100 | 35 |
| C72 | C72 | $1.0 \times 10^{13}$ | Not found | 1500 | 4 |
| C73 | C73 | $1.0 \times 10^{9}$ | Not found | 7000 | 36 |
| C74 | C74 | $1.0 \times 10^{11}$ | Not found | 6100 | 34 |
| C75 | C75 | $1.0 \times 10^{10}$ | Not found | 2400 | 5 |
| C76 | C76 | $1.0 \times 10^{12}$ | Not found | 1800 | 4 |
| C77 | C77 | $1.0 \times 10^{9}$ | Not found | 7000 | 36 |
| C78 | C78 | $1.0 \times 10^{11}$ | Not found | 6100 | 34 |
| C79 | C79 | $1.0 \times 10^{10}$ | Not found | 2400 | 5 |
| C80 | C80 | $1.0 \times 10^{12}$ | Not found | 1800 | 4 |

TABLE 15

| Electro-photographic photosensitive member | Coating solution for conductive layer | Volume resistivity of conductive layer [Ω · cm] | Crack of conductive layer | Current amount la[μA] | lb[μA] |
|---|---|---|---|---|---|
| C81 | C81 | $1.0 \times 10^{9}$ | Not found | 7100 | 44 |
| C82 | C82 | $1.0 \times 10^{11}$ | Not found | 4000 | 6 |
| C83 | C83 | $1.0 \times 10^{10}$ | Not found | 6300 | 42 |
| C84 | C84 | $1.0 \times 10^{12}$ | Not found | 3200 | 6 |
| C85 | C85 | $1.0 \times 10^{9}$ | Not found | 7100 | 44 |
| C86 | C86 | $1.0 \times 10^{11}$ | Not found | 4000 | 6 |
| C87 | C87 | $1.0 \times 10^{10}$ | Not found | 6300 | 42 |
| C88 | C88 | $1.0 \times 10^{12}$ | Not found | 3200 | 6 |
| C89 | C89 | $1.0 \times 10^{9}$ | Not found | 7600 | 44 |
| C90 | C90 | $1.0 \times 10^{11}$ | Not found | 4500 | 8 |
| C91 | C91 | $1.0 \times 10^{10}$ | Not found | 6800 | 43 |
| C92 | C92 | $1.0 \times 10^{12}$ | Not found | 3700 | 7 |
| C93 | C93 | $1.0 \times 10^{9}$ | Not found | 7600 | 44 |
| C94 | C94 | $1.0 \times 10^{11}$ | Not found | 4500 | 8 |
| C95 | C95 | $1.0 \times 10^{10}$ | Not found | 6800 | 43 |
| C96 | C96 | $1.0 \times 10^{12}$ | Not found | 3700 | 7 |
| C97 | C97 | $1.0 \times 10^{10}$ | Not found | 11000 | 55 |
| C98 | C98 | $1.0 \times 10^{10}$ | Not found | 7400 | 52 |
| C99 | C99 | $1.0 \times 10^{11}$ | Not found | 3200 | 2 |
| C100 | C100 | $1.0 \times 10^{11}$ | Not found | 3400 | 3 |
| C101 | C101 | $1.0 \times 10^{11}$ | Not found | 3100 | 2 |

Examples 1 to 110 and Comparative Examples 1 to 101

Each of the electrophotographic photosensitive members 1 to 110 and C1 to C101 was mounted on a laser beam printer (trade name: HP Laserjet P1505) made by Hewlett-Packard Company, and a sheet feeding durability test was performed under a low temperature and low humidity (15° C./10% RH) environment to evaluate an image. In the sheet feeding durability test, a text image having a coverage rate of 2% was printed on a letter size sheet one by one in an intermittent mode, and 3000 sheets of the image were output.

Figure 9:
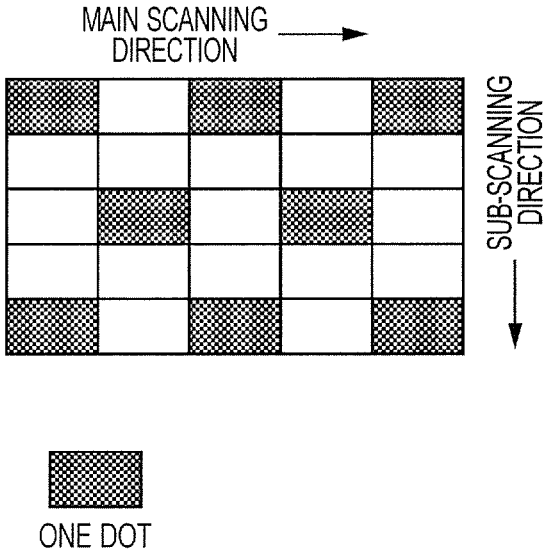
FIG. 9 is a drawing for describing a one dot Keima (similar to knight's move) pattern image.

Then, a sheet of a sample for image evaluation (halftone image of one dot Keima pattern) was output every time when the sheet feeding durability test was started, when 1500 sheets of the image were output, and when 3000 sheets of the image were output. The halftone image of one dot Keima pattern is a halftone image having the pattern illustrated in FIG. 9.

The image was evaluated on the following criterion. The results are shown in Tables 16 to 21.

A: no leakage occurs.

B: a leakage is slightly found as small black dots.

C: a leakage is clearly found as larger black dots.

D: a leakage is found as large black dots and short horizontal black stripes.

E: a leakage is found as long horizontal black stripes.

The charge potential (dark potential) and the potential during exposure (bright potential) were measured after the sample for image evaluation was output at the time of starting the sheet feeding durability test and after outputting 3,000 sheets of the image. The measurement of the potential was performed using one white solid image and one black solid image. The dark potential at the initial stage (when the sheet feeding durability test was started) was Vd, and the bright potential at the initial stage (when the sheet feeding durability test was started) was Vl. The dark potential after 3000 sheets of the image were output was Vd', and the bright potential after 3000 sheets of the image were output was Vl'. The difference between the dark potential Vd' after 3000 sheets of the image were output and the dark potential Vd at the initial stage, i.e., the amount of the dark potential to be changed ΔVd (=|Vd'|−|Vd|) was determined. Moreover, the difference between the bright potential Vl' after 3000 sheets of the image were output and the bright potential Vl at the initial stage, i.e., the amount of the bright potential to be changed ΔVl (=|Vl'|−|Vl|) was determined. The result is shown in Tables 16 to 21.

TABLE 16

| Example | Electro-photographic photosensitive member | Leakage: When sheet feeding durability test is started | When 1500 sheets of image are output | When 3000 sheets of image are output | Amount of potential to be changed [V] ΔVd | ΔVl |
|---|---|---|---|---|---|---|
| 1 | 1 | A | A | B | +10 | +20 |
| 2 | 2 | A | A | A | +10 | +25 |
| 3 | 3 | A | A | A | +11 | +25 |
| 4 | 4 | A | A | A | +10 | +25 |
| 5 | 5 | A | A | A | +12 | +32 |
| 6 | 6 | A | A | B | +10 | +20 |
| 7 | 7 | A | A | A | +11 | +22 |
| 8 | 8 | A | A | A | +10 | +25 |
| 9 | 9 | A | A | A | +10 | +31 |
| 10 | 10 | A | A | B | +10 | +20 |
| 11 | 11 | A | A | A | +10 | +25 |
| 12 | 12 | A | A | A | +10 | +26 |
| 13 | 13 | A | A | A | +11 | +33 |
| 14 | 14 | A | A | A | +10 | +21 |
| 15 | 15 | A | A | A | +11 | +25 |
| 16 | 16 | A | B | B | +10 | +20 |
| 17 | 17 | A | A | A | +10 | +35 |
| 18 | 18 | A | A | B | +10 | +20 |
| 19 | 19 | A | A | A | +10 | +25 |
| 20 | 20 | A | A | A | +11 | +25 |
| 21 | 21 | A | A | A | +10 | +25 |
| 22 | 22 | A | A | A | +12 | +32 |
| 23 | 23 | A | A | B | +10 | +20 |
| 24 | 24 | A | A | A | +11 | +22 |

TABLE 16-continued

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 25 | 25 | A | A | A | +10 | +25 |
| 26 | 26 | A | A | A | +10 | +31 |
| 27 | 27 | A | A | B | +10 | +20 |
| 28 | 28 | A | A | A | +10 | +25 |
| 29 | 29 | A | A | A | +10 | +26 |
| 30 | 30 | A | A | A | +11 | +33 |
| 31 | 31 | A | A | A | +10 | +21 |
| 32 | 32 | A | A | A | +11 | +25 |
| 33 | 33 | A | B | B | +10 | +20 |
| 34 | 34 | A | A | A | +10 | +35 |
| 35 | 35 | A | A | B | +10 | +19 |
| 36 | 36 | A | A | A | +10 | +24 |
| 37 | 37 | A | A | A | +11 | +24 |
| 38 | 38 | A | A | A | +10 | +24 |
| 39 | 39 | A | A | A | +12 | +31 |
| 40 | 40 | A | A | B | +10 | +19 |

TABLE 17

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 41 | 41 | A | A | A | +11 | +21 |
| 42 | 42 | A | A | A | +10 | +24 |
| 43 | 43 | A | A | A | +10 | +30 |
| 44 | 44 | A | A | B | +10 | +19 |
| 45 | 45 | A | A | A | +10 | +24 |
| 46 | 46 | A | A | A | +10 | +25 |
| 47 | 47 | A | A | A | +11 | +32 |
| 48 | 48 | A | A | A | +10 | +20 |
| 49 | 49 | A | A | A | +11 | +24 |
| 50 | 50 | A | B | B | +10 | +19 |
| 51 | 51 | A | A | A | +10 | +35 |
| 52 | 52 | A | A | B | +10 | +19 |
| 53 | 53 | A | A | A | +10 | +24 |
| 54 | 54 | A | A | A | +11 | +24 |
| 55 | 55 | A | A | A | +10 | +24 |
| 56 | 56 | A | A | A | +12 | +31 |
| 57 | 57 | A | A | B | +10 | +19 |
| 58 | 58 | A | A | A | +11 | +21 |
| 59 | 59 | A | A | A | +10 | +24 |
| 60 | 60 | A | A | A | +10 | +30 |
| 61 | 61 | A | A | B | +10 | +19 |
| 62 | 62 | A | A | A | +10 | +24 |
| 63 | 63 | A | A | A | +10 | +25 |
| 64 | 64 | A | A | A | +11 | +32 |
| 65 | 65 | A | A | A | +10 | +20 |
| 66 | 66 | A | A | A | +11 | +24 |
| 67 | 67 | A | B | B | +10 | +19 |
| 68 | 68 | A | A | A | +10 | +35 |
| 69 | 69 | A | A | B | +10 | +21 |
| 70 | 70 | A | A | A | +10 | +26 |
| 71 | 71 | A | A | A | +11 | +25 |
| 72 | 72 | A | A | A | +10 | +25 |
| 73 | 73 | A | A | A | +12 | +33 |
| 74 | 74 | A | A | B | +10 | +21 |
| 75 | 75 | A | A | A | +11 | +23 |
| 76 | 76 | A | A | A | +10 | +26 |
| 77 | 77 | A | A | A | +10 | +32 |
| 78 | 78 | A | A | B | +10 | +21 |
| 79 | 79 | A | A | A | +10 | +25 |
| 80 | 80 | A | A | A | +10 | +26 |

TABLE 18

| Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 81 | 81 | A | A | A | +11 | +34 |
| 82 | 82 | A | A | A | +10 | +21 |
| 83 | 83 | A | A | A | +11 | +25 |
| 84 | 84 | A | B | B | +10 | +21 |
| 85 | 85 | A | A | A | +10 | +35 |
| 86 | 86 | A | A | B | +10 | +21 |
| 87 | 87 | A | A | A | +10 | +26 |
| 88 | 88 | A | A | A | +11 | +25 |
| 89 | 89 | A | A | A | +10 | +25 |
| 90 | 90 | A | A | A | +12 | +33 |
| 91 | 91 | A | A | B | +10 | +21 |
| 92 | 92 | A | A | A | +11 | +23 |
| 93 | 93 | A | A | A | +10 | +26 |
| 94 | 94 | A | A | A | +10 | +32 |
| 95 | 95 | A | A | B | +10 | +21 |
| 96 | 96 | A | A | A | +10 | +25 |
| 97 | 97 | A | A | A | +10 | +26 |
| 98 | 98 | A | A | A | +11 | +34 |
| 99 | 99 | A | A | A | +10 | +21 |
| 100 | 100 | A | A | A | +11 | +25 |
| 101 | 101 | A | B | B | +10 | +21 |
| 102 | 102 | A | A | A | +10 | +35 |
| 103 | 103 | A | B | B | +10 | +22 |
| 104 | 104 | A | A | B | +10 | +33 |
| 105 | 105 | A | B | B | +10 | +22 |
| 106 | 106 | A | A | B | +11 | +35 |
| 107 | 107 | A | B | B | +10 | +22 |
| 108 | 108 | A | A | B | +10 | +33 |
| 109 | 109 | A | B | B | +10 | +22 |
| 110 | 110 | A | A | B | +11 | +35 |

TABLE 19

| Comparative Example | Electro-photographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl |
|---|---|---|---|---|---|---|
| 1 | C1 | C | C | C | +10 | +24 |
| 2 | C2 | A | A | A | +12 | +55 |
| 3 | C3 | C | C | D | +10 | +24 |
| 4 | C4 | B | C | C | +11 | +24 |
| 5 | C5 | A | A | A | +12 | +50 |
| 6 | C6 | A | A | A | +13 | +60 |
| 7 | C7 | B | C | C | +10 | +24 |
| 8 | C8 | C | C | D | +10 | +24 |
| 9 | C9 | A | A | A | +12 | +60 |
| 10 | C10 | B | B | B | +11 | +45 |
| 11 | C11 | B | B | C | +10 | +25 |
| 12 | C12 | A | A | A | +12 | +65 |
| 13 | C13 | C | C | C | +10 | +24 |
| 14 | C14 | A | A | A | +12 | +55 |
| 15 | C15 | C | C | D | +10 | +24 |
| 16 | C16 | B | C | C | +11 | +24 |
| 17 | C17 | A | A | A | +12 | +50 |
| 18 | C18 | A | A | A | +13 | +60 |
| 19 | C19 | B | C | C | +10 | +24 |
| 20 | C20 | C | C | D | +10 | +24 |
| 21 | C21 | A | A | A | +12 | +60 |
| 22 | C22 | B | B | B | +11 | +45 |
| 23 | C23 | B | B | C | +10 | +25 |
| 24 | C24 | A | A | A | +12 | +65 |
| 25 | C25 | C | C | D | +10 | +23 |
| 26 | C26 | A | A | A | +12 | +54 |
| 27 | C27 | C | D | D | +10 | +23 |
| 28 | C28 | C | C | C | +11 | +23 |
| 29 | C29 | A | A | A | +12 | +49 |

TABLE 19-continued

| Comparative Example | Electro-photographic photosensitive member | Leakage: When sheet feeding durability test is started | Leakage: When 1500 sheets of image are output | Leakage: When 3000 sheets of image are output | Amount of potential to be changed [V]: ΔVd | Amount of potential to be changed [V]: ΔVl |
|---|---|---|---|---|---|---|
| 30 | C30 | A | A | A | +13 | +59 |
| 31 | C31 | C | C | C | +10 | +23 |
| 32 | C32 | C | D | D | +10 | +23 |
| 33 | C33 | A | A | A | +12 | +59 |
| 34 | C34 | B | B | C | +11 | +44 |
| 35 | C35 | B | C | C | +10 | +24 |
| 36 | C36 | A | A | A | +12 | +64 |
| 37 | C37 | C | C | D | +10 | +23 |
| 38 | C38 | A | A | A | +12 | +54 |
| 39 | C39 | C | D | D | +10 | +23 |
| 40 | C40 | C | C | C | +11 | +23 |

TABLE 20

| Comparative Example | Electro-photographic photosensitive member | Leakage: When sheet feeding durability test is started | Leakage: When 1500 sheets of image are output | Leakage: When 3000 sheets of image are output | Amount of potential to be changed [V]: ΔVd | Amount of potential to be changed [V]: ΔVl |
|---|---|---|---|---|---|---|
| 41 | C41 | A | A | A | +12 | +49 |
| 42 | C42 | A | A | A | +13 | +59 |
| 43 | C43 | C | C | C | +10 | +23 |
| 44 | C44 | C | D | D | +10 | +23 |
| 45 | C45 | A | A | A | +12 | +59 |
| 46 | C46 | B | B | C | +11 | +44 |
| 47 | C47 | B | C | C | +10 | +24 |
| 48 | C48 | A | A | A | +12 | +64 |
| 49 | C49 | C | C | C | +10 | +25 |
| 50 | C50 | A | A | A | +12 | +56 |
| 51 | C51 | C | C | D | +10 | +25 |
| 52 | C52 | B | C | C | +11 | +25 |
| 53 | C53 | A | A | A | +12 | +50 |
| 54 | C54 | A | A | A | +13 | +60 |
| 55 | C55 | B | C | C | +10 | +25 |
| 56 | C56 | C | C | D | +10 | +25 |
| 57 | C57 | A | A | A | +12 | +60 |
| 58 | C58 | B | B | B | +11 | +46 |
| 59 | C59 | B | B | C | +10 | +26 |
| 60 | C60 | A | A | A | +12 | +65 |
| 61 | C61 | C | C | C | +10 | +25 |
| 62 | C62 | A | A | A | +12 | +56 |
| 63 | C63 | C | C | D | +10 | +25 |
| 64 | C64 | B | C | C | +11 | +25 |
| 65 | C65 | A | A | A | +12 | +50 |
| 66 | C66 | A | A | A | +13 | +60 |
| 67 | C67 | B | C | C | +10 | +25 |
| 68 | C68 | C | C | D | +10 | +25 |
| 69 | C69 | A | A | A | +12 | +60 |
| 70 | C70 | B | B | B | +11 | +46 |
| 71 | C71 | B | B | C | +10 | +26 |
| 72 | C72 | A | A | A | +12 | +65 |
| 73 | C73 | C | C | D | +10 | +26 |
| 74 | C74 | B | C | C | +11 | +26 |
| 75 | C75 | A | A | A | +12 | +52 |
| 76 | C76 | A | A | A | +13 | +60 |
| 77 | C77 | C | C | D | +10 | +26 |
| 78 | C78 | B | C | C | +11 | +26 |
| 79 | C79 | A | A | A | +12 | +52 |
| 80 | C80 | A | A | A | +13 | +60 |

TABLE 21

| Comparative Example | Electro-photographic photosensitive member | Leakage: When sheet feeding durability test is started | Leakage: When 1500 sheets of image are output | Leakage: When 3000 sheets of image are output | Amount of potential to be changed [V]: ΔVd | Amount of potential to be changed [V]: ΔVl |
|---|---|---|---|---|---|---|
| 81 | C81 | D | D | D | +10 | +23 |
| 82 | C82 | B | C | C | +10 | +40 |
| 83 | C83 | C | D | D | +10 | +23 |
| 84 | C84 | B | B | B | +11 | +45 |
| 85 | C85 | D | D | D | +10 | +23 |
| 86 | C86 | B | C | C | +10 | +40 |
| 87 | C87 | C | D | D | +10 | +23 |
| 88 | C88 | B | B | B | +11 | +45 |
| 89 | C89 | D | E | E | +10 | +22 |
| 90 | C90 | B | C | C | +10 | +41 |
| 91 | C91 | D | D | E | +11 | +22 |
| 92 | C92 | B | B | B | +12 | +47 |
| 93 | C93 | D | E | E | +10 | +22 |
| 94 | C94 | B | C | C | +10 | +41 |
| 95 | C95 | D | D | E | +11 | +22 |
| 96 | C96 | B | B | B | +12 | +47 |
| 97 | C97 | E | E | E | +10 | +20 |
| 98 | C98 | B | C | C | +10 | +24 |
| 99 | C99 | A | A | A | +11 | +70 |
| 100 | C100 | A | A | A | +11 | +70 |
| 101 | C101 | A | A | A | +11 | +70 |

Examples 111 to 220 and Comparative Examples 102 to 202

In addition to the electrophotographic photosensitive members 1 to 110 and C1 to C101 subjected to the sheet feeding durability test, another electrophotographic photosensitive members 1 to 110 and C1 to C101 were prepared, and subjected to the probe pressure resistance test as follows. The results are shown in Tables 22 and 23.

Figure 4:
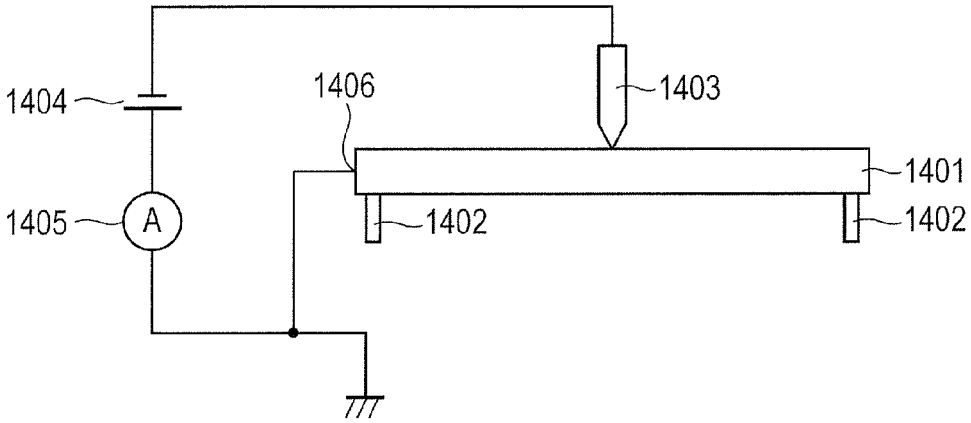
FIG. 4 is a drawing illustrating an example of a probe pressure resistance test apparatus.

A probe pressure resistance test apparatus is illustrated in FIG. 4. The probe pressure resistance test is performed under a normal temperature and normal humidity (23° C./50% RH) environment. Both ends of the electrophotographic photosensitive member 1401 are disposed on fixing bases 1402, and fixed such that the electrophotographic photosensitive member 1401 does not move. The tip of the probe electrode 1403 is brought into contact with the surface of the electrophotographic photosensitive member 1401. To the probe electrode 1403, a power supply 1404 for applying voltage and an ammeter 1405 for measuring current are connected. A portion 1406 contacting the support in the electrophotographic photosensitive member 1401 is connected to a ground. The voltage to be applied for 2 seconds from the probe electrode 1403 is raised from 0 V in increment of 10 V. The probe pressure resistance value is defined as the voltage when the leakage occurs inside of the electrophotographic photosensitive member 1401 contacted by the tip of the probe electrode 1403, and the value indicated by the ammeter 1405 becomes to be 10 times or more larger. Five points on the surface of the electrophotographic photosensitive member 1401 are measured as above, and the average value is defined as the measured probe pressure resistance value of the electrophotographic photosensitive member 1401.

TABLE 22

| Example | Electrophotographic photosensitive member | Probe pressure resistance value [−V] |
|---|---|---|
| 111 | 1 | 4100 |
| 112 | 2 | 4750 |

TABLE 22-continued

| Example | Electrophotographic photosensitive member | Probe pressure resistance value [−V] |
|---|---|---|
| 113 | 3 | 4800 |
| 114 | 4 | 4850 |
| 115 | 5 | 4900 |
| 116 | 6 | 4050 |
| 117 | 7 | 4700 |
| 118 | 8 | 4800 |
| 119 | 9 | 4850 |
| 120 | 10 | 4200 |
| 121 | 11 | 4800 |
| 122 | 12 | 4900 |
| 123 | 13 | 4950 |
| 124 | 14 | 4600 |
| 125 | 15 | 4850 |
| 126 | 16 | 4000 |
| 127 | 17 | 5000 |
| 128 | 18 | 4100 |
| 129 | 19 | 4750 |
| 130 | 20 | 4800 |
| 131 | 21 | 4850 |
| 132 | 22 | 4900 |
| 133 | 23 | 4050 |
| 134 | 24 | 4700 |
| 135 | 25 | 4800 |
| 136 | 26 | 4850 |
| 137 | 27 | 4200 |
| 138 | 28 | 4800 |
| 139 | 29 | 4900 |
| 140 | 30 | 4950 |
| 141 | 31 | 4600 |
| 142 | 32 | 4850 |
| 143 | 33 | 4000 |
| 144 | 34 | 5000 |
| 145 | 35 | 4080 |
| 146 | 36 | 4730 |
| 147 | 37 | 4780 |
| 148 | 38 | 4830 |
| 149 | 39 | 4880 |
| 150 | 40 | 4030 |
| 151 | 41 | 4680 |
| 152 | 42 | 4780 |
| 153 | 43 | 4830 |
| 154 | 44 | 4180 |
| 155 | 45 | 4780 |

TABLE 22-continued

| Example | Electrophotographic photosensitive member | Probe pressure resistance value [−V] |
|---|---|---|
| 156 | 46 | 4880 |
| 157 | 47 | 4930 |
| 158 | 48 | 4580 |
| 159 | 49 | 4830 |
| 160 | 50 | 4000 |
| 161 | 51 | 4980 |
| 162 | 52 | 4080 |
| 163 | 53 | 4730 |
| 164 | 54 | 4780 |
| 165 | 55 | 4830 |
| 166 | 56 | 4880 |
| 167 | 57 | 4030 |
| 168 | 58 | 4680 |
| 169 | 59 | 4780 |
| 170 | 60 | 4830 |
| 171 | 61 | 4180 |
| 172 | 62 | 4780 |
| 173 | 63 | 4880 |
| 174 | 64 | 4930 |
| 175 | 65 | 4580 |
| 176 | 66 | 4830 |
| 177 | 67 | 4000 |
| 178 | 68 | 4980 |
| 179 | 69 | 4110 |
| 180 | 70 | 4760 |
| 181 | 71 | 4810 |
| 182 | 72 | 4860 |
| 183 | 73 | 4910 |
| 184 | 74 | 4060 |
| 185 | 75 | 4710 |
| 186 | 76 | 4810 |
| 187 | 77 | 4860 |
| 188 | 78 | 4200 |
| 189 | 79 | 4810 |
| 190 | 80 | 4910 |
| 191 | 81 | 4960 |
| 192 | 82 | 4610 |
| 193 | 83 | 4860 |
| 194 | 84 | 4000 |
| 195 | 85 | 5000 |
| 196 | 86 | 4110 |
| 197 | 87 | 4760 |
| 198 | 88 | 4810 |
| 199 | 89 | 4860 |
| 200 | 90 | 4910 |
| 201 | 91 | 4060 |
| 202 | 92 | 4710 |
| 203 | 93 | 4810 |
| 204 | 94 | 4860 |
| 205 | 95 | 4200 |
| 206 | 96 | 4810 |
| 207 | 97 | 4910 |
| 208 | 98 | 4960 |
| 209 | 99 | 4610 |
| 210 | 100 | 4860 |
| 211 | 101 | 4000 |
| 212 | 102 | 5000 |
| 213 | 103 | 4060 |
| 214 | 104 | 4860 |
| 215 | 105 | 4200 |
| 216 | 106 | 4960 |
| 217 | 107 | 4060 |
| 218 | 108 | 4860 |
| 219 | 109 | 4200 |
| 220 | 110 | 4960 |

TABLE 23

| Comparative Example | Electrophotographic photosensitive member | Probe pressure resistance value [−V] |
|---|---|---|
| 102 | C1 | 3200 |
| 103 | C2 | 4950 |
| 104 | C3 | 3100 |

TABLE 23-continued

| Comparative Example | Electrophotographic photosensitive member | Probe pressure resistance value [−V] |
|---|---|---|
| 105 | C4 | 3300 |
| 106 | C5 | 4900 |
| 107 | C6 | 5000 |
| 108 | C7 | 3300 |
| 109 | C8 | 2100 |
| 110 | C9 | 5000 |
| 111 | C10 | 3800 |
| 112 | C11 | 3500 |
| 113 | C12 | 5000 |
| 114 | C13 | 3200 |
| 115 | C14 | 4950 |
| 116 | C15 | 3100 |
| 117 | C16 | 3300 |
| 118 | C17 | 4900 |
| 119 | C18 | 5000 |
| 120 | C19 | 3300 |
| 121 | C20 | 2100 |
| 122 | C21 | 5000 |
| 123 | C22 | 3800 |
| 124 | C23 | 3500 |
| 125 | C24 | 5000 |
| 126 | C25 | 3180 |
| 127 | C26 | 4930 |
| 128 | C27 | 3080 |
| 129 | C28 | 3280 |
| 130 | C29 | 4880 |
| 131 | C30 | 4980 |
| 132 | C31 | 3280 |
| 133 | C32 | 2080 |
| 134 | C33 | 4980 |
| 135 | C34 | 3780 |
| 136 | C35 | 3480 |
| 137 | C36 | 4980 |
| 138 | C37 | 3180 |
| 139 | C38 | 4930 |
| 140 | C39 | 3080 |
| 141 | C40 | 3280 |
| 142 | C41 | 4880 |
| 143 | C42 | 4980 |
| 144 | C43 | 3280 |
| 145 | C44 | 2080 |
| 146 | C45 | 4980 |
| 147 | C46 | 3780 |
| 148 | C47 | 3480 |
| 149 | C48 | 4980 |
| 150 | C49 | 3220 |
| 151 | C50 | 4970 |
| 152 | C51 | 3120 |
| 153 | C52 | 3320 |
| 154 | C53 | 4920 |
| 155 | C54 | 5000 |
| 156 | C55 | 3320 |
| 157 | C56 | 2120 |
| 158 | C57 | 5000 |
| 159 | C58 | 3820 |
| 160 | C59 | 3500 |
| 161 | C60 | 5000 |
| 162 | C61 | 3220 |
| 163 | C62 | 4970 |
| 164 | C63 | 3120 |
| 165 | C64 | 3320 |
| 166 | C65 | 4920 |
| 167 | C66 | 5000 |
| 168 | C67 | 3320 |
| 169 | C68 | 2120 |
| 170 | C69 | 5000 |
| 171 | C70 | 3820 |
| 172 | C71 | 3500 |
| 173 | C72 | 5000 |
| 174 | C73 | 3120 |
| 175 | C74 | 3320 |
| 176 | C75 | 4920 |
| 177 | C76 | 5000 |
| 178 | C77 | 3120 |
| 179 | C78 | 3320 |
| 180 | C79 | 4920 |
| 181 | C80 | 5000 |

TABLE 23-continued

| Comparative Example | Electrophotographic photosensitive member | Probe pressure resistance value [−V] |
|---|---|---|
| 182 | C81 | 2900 |
| 183 | C82 | 4730 |
| 184 | C83 | 3000 |
| 185 | C84 | 4830 |
| 186 | C85 | 2900 |
| 187 | C86 | 4730 |
| 188 | C87 | 3000 |
| 189 | C88 | 4830 |
| 190 | C89 | 2500 |
| 191 | C90 | 4630 |
| 192 | C91 | 2700 |
| 193 | C92 | 4740 |
| 194 | C93 | 2500 |
| 195 | C94 | 4630 |
| 196 | C95 | 2700 |
| 197 | C96 | 4740 |
| 198 | C97 | 2000 |
| 199 | C98 | 3100 |
| 200 | C99 | 4850 |
| 201 | C100 | 4850 |
| 202 | C101 | 4850 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-189531, filed Aug. 30, 2012, Japanese Patent Application No. 2013-012117, filed Jan. 25, 2013, Japanese Patent Application No. 2013-012125, filed Jan. 25, 2013, and Japanese Patent Application No. 2013-053506, filed Mar. 15, 2013, which are hereby incorporated by reference herein in their entirety.

What is claimed is:

1. An electrophotographic photosensitive member comprising:

a cylindrical support, a conductive layer formed on the cylindrical support, and a photosensitive layer formed on the conductive layer, wherein, the conductive layer comprises:

a metal oxide particle coated with tin oxide doped with niobium or tantalum, and a binder material, Ia and Ib satisfy relations (i) and (ii):

$$Ia \leq 6{,}000 \quad \text{(i)}$$

$$10 \leq Ib \quad \text{(ii)}$$

where, in the relation (i), Ia [μA] is an absolute value of the largest amount of a current flowing through the conductive layer when a test which continuously applies a voltage having only a DC voltage of −1.0 kV to the conductive layer is performed, and, in the relation (ii), Ib [μA] is an absolute value of an amount of a current flowing through the conductive layer when a decrease rate per minute of the current flowing through the conductive layer reaches 1% or less for the first time, and the conductive layer before the test is performed has a volume resistivity of not less than $1.0\times10^{8}$ Ω·cm and not more than $5.0\times10^{12}$ Ω·cm.

2. The electrophotographic photosensitive member according to claim 1, wherein the metal oxide particle coated with tin oxide doped with niobium or tantalum is titanium oxide particle coated with tin oxide doped with niobium.

3. The electrophotographic photosensitive member according to claim 1, wherein the metal oxide particle coated with tin oxide doped with niobium or tantalum is titanium oxide particle coated with tin oxide doped with tantalum.

4. The electrophotographic photosensitive member according to claim 1, wherein the metal oxide particle coated with tin oxide doped with niobium or tantalum is tin oxide particle coated with tin oxide doped with niobium.

5. The electrophotographic photosensitive member according to claim 1, wherein the metal oxide particle coated with tin oxide doped with niobium or tantalum is tin oxide particle coated with tin oxide doped with tantalum.

6. The electrophotographic photosensitive member according to claim 1, wherein the metal oxide particle coated with tin oxide doped with niobium or tantalum is zinc oxide particle coated with tin oxide doped with niobium.

7. The electrophotographic photosensitive member according to claim 1, wherein the metal oxide particle coated with tin oxide doped with niobium or tantalum is zinc oxide particle coated with tin oxide doped with tantalum.

8. The electrophotographic photosensitive member according to claim 1, wherein the Ia and the Ib satisfy relations (iii) and (iv):

$$Ia \leq 5{,}000 \quad \text{(iii)}$$

$$20 \leq Ib \quad \text{(iv)}.$$

9. A process cartridge that integrally supports:

an electrophotographic photosensitive member according to claim 1, and at least one unit selected from the group consisting of a charging unit, a developing unit, a transferring unit, and a cleaning unit, the cartridge being detachably mountable on a main body of an electrophotographic apparatus.

10. An electrophotographic apparatus comprising:

an electrophotographic photosensitive member according to claim 1, a charging unit, an exposing unit, a developing unit, and a transferring unit.

11. A method for producing an electrophotographic photosensitive member comprising:

forming a conductive layer having a volume resistivity of not less than $1.0\times10^{8}$ Ω·cm and not more than $5.0\times10^{12}$ Ω·cm on a cylindrical support, and forming a photosensitive layer on the conductive layer, wherein, the formation of the conductive layer is preparing a coating solution for a conductive layer using a solvent, a binder material, and metal oxide particle coated with tin oxide doped with niobium or tantalum, and forming the conductive layer using the coating solution for a conductive layer, the metal oxide particle coated with tin oxide doped with niobium or tantalum used for preparation of the coating solution for a conductive layer has a powder resistivity of not less than $1.0\times10^{3}$ Ω·cm and not more than $1.0\times10^{5}$ Ω·cm, and the mass ratio (P/B) of the metal oxide particle coated with tin oxide doped with niobium or tantalum (P) to the binder material (B) in the coating solution for a conductive layer is not less than 1.5/1.0 and not more than 3.5/1.0.

12. The method for producing an electrophotographic photosensitive member according to claim 11, wherein the powder resistivity of the metal oxide particle coated with tin oxide doped with niobium or tantalum used for preparation of the coating solution for a conductive layer is not less than $3.0\times10^3$ Ω·cm and not more than $5.0\times10^4$ Ω·cm.

13. The method for producing an electrophotographic photosensitive member according to claim 11, wherein the metal oxide particle coated with tin oxide doped with niobium or tantalum is titanium oxide particle coated with tin oxide doped with niobium.

14. The method for producing an electrophotographic photosensitive member according to claim 11, wherein the metal oxide particle coated with tin oxide doped with niobium or tantalum is titanium oxide particle coated with tin oxide doped with tantalum.

15. The method for producing an electrophotographic photosensitive member according to claim 11, wherein the metal oxide particle coated with tin oxide doped with niobium or tantalum is tin oxide particle coated with tin oxide doped with niobium.

16. The method for producing an electrophotographic photosensitive member according to claim 11, wherein the metal oxide particle coated with tin oxide doped with niobium or tantalum is tin oxide particle coated with tin oxide doped with tantalum.

17. The method for producing an electrophotographic photosensitive member according to claim 11, wherein the metal oxide particle coated with tin oxide doped with niobium or tantalum is zinc oxide particle coated with tin oxide doped with niobium.

18. The method for producing an electrophotographic photosensitive member according to claim 11, wherein the metal oxide particle coated with tin oxide doped with niobium or tantalum is zinc oxide particle coated with tin oxide doped with tantalum.

* * * * *